US008843003B2

(12) United States Patent
Nakao

(10) Patent No.: US 8,843,003 B2
(45) Date of Patent: Sep. 23, 2014

(54) IMAGE FORMING APPARATUS, IMAGE FORMING SYSTEM, AND IMAGE FORMING METHOD

(75) Inventor: Yoshihisa Nakao, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 222 days.

(21) Appl. No.: 13/406,070

(22) Filed: Feb. 27, 2012

(65) Prior Publication Data

US 2013/0039673 A1 Feb. 14, 2013

(30) Foreign Application Priority Data

Aug. 8, 2011 (JP) ..... 2011-173027

(51) Int. Cl.
*G03G 15/00* (2006.01)
*G03G 15/23* (2006.01)

(52) U.S. Cl.
CPC ..... *G03G 15/234* (2013.01); *G03G 15/5062* (2013.01); *G06G 15/6561* (2013.01)
USPC ..... 399/15; 399/66

(58) Field of Classification Search
CPC combination set(s) only.
See application file for complete search history.

(56) References Cited

U.S. PATENT DOCUMENTS

2010/0067925 A1* 3/2010 Mori ..... 399/15

FOREIGN PATENT DOCUMENTS

| | | | |
|---|---|---|---|
| JP | 2002-023562 | A | 1/2002 |
| JP | 2004-226481 | A | 8/2004 |
| JP | 2004-246152 | A | 9/2004 |
| JP | 4359051 | A | 9/2004 |

* cited by examiner

*Primary Examiner* — Clayton E Laballe
*Assistant Examiner* — Jas Sanghera
(74) *Attorney, Agent, or Firm* — Sughrue Mion, PLLC

(57) ABSTRACT

An image forming apparatus includes an image holding member, a transfer unit, a fixing unit, a transport unit, a transfer-performance-detection toner image forming unit, a density detection unit, and a selector. A toner image is held on the image holding member. The transfer unit transfers the toner image onto a recording medium. The fixing unit fixes the toner image onto the recording medium. The transport unit reverses the recording medium onto which the toner image has been fixed, and transports the reversed recording medium back to the transfer unit. The transfer-performance-detection toner image forming unit forms plural transfer-performance-detection toner images with different transfer settings of the transfer unit. The density detection unit detects densities of plural transfer-performance-detection toner images. The selector selects a transfer setting of the transfer unit in accordance with a detection result obtained by the density detection unit.

13 Claims, 18 Drawing Sheets

FIG. 20

● OK
○ NG

| | −5 | −4 | −3 | −2 | −1 | 0 | 1 | 2 | 3 | 4 | 5 | 6 | 7 | 8 | 9 | 10 |
|---|---|---|---|---|---|---|---|---|---|---|---|---|---|---|---|---|
| NO IMAGE ON BACK SIDE | ○ | ○ | ● | ● | ● | ● | ○ | ○ | ○ | ○ | ○ | ○ | ○ | ○ | ○ | ○ |
| IMAGE ON BACK SIDE | ○ | ○ | ○ | ● | ● | ● | ○ | ○ | ○ | ○ | ○ | ○ | ○ | ○ | ○ | ○ |

RECOMMENDED VALUE TAKING INTO ACCOUNT WHETHER IMAGE IS FORMED ON BACK SIDE

IMAGE FORMING APPARATUS, IMAGE FORMING SYSTEM, AND IMAGE FORMING METHOD

CROSS-REFERENCE TO RELATED APPLICATIONS

This application is based on and claims priority under 35 USC 119 from Japanese Patent Application No. 2011-173027 filed Aug. 8, 2011.

BACKGROUND

(i) Technical Field

The present invention relates to an image forming apparatus, an image forming system, and an image forming method.

SUMMARY

According to an aspect of the invention, there is provided an image forming apparatus including an image holding member, a transfer unit, a fixing unit, a transport unit, a transfer-performance-detection toner image forming unit, a density detection unit, and a selector. A toner image is held on the image holding member. The transfer unit transfers the toner image held on the image holding member onto a recording medium having a first side and a second side. The fixing unit fixes the toner image transferred onto the recording medium by the transfer unit. The transport unit reverses the recording medium having the toner image fixed onto the first side by the fixing unit, and transports the reversed recording medium back to the transfer unit. The transfer-performance-detection toner image forming unit forms plural transfer-performance-detection toner images with different transfer settings of the transfer unit so that a transfer-performance-detection toner image to be formed on the first side of the recording medium and a transfer-performance-detection toner image to be formed on the second side of the recording medium at least partly overlap each other. The density detection unit detects densities of plural transfer-performance-detection toner images transferred onto the second side of the recording medium or densities of plural transfer-performance-detection toner images which remain on the image holding member after plural transfer-performance-detection toner images have been transferred onto the second side of the recording medium. The selector selects a transfer setting of the transfer unit in accordance with a detection result obtained by the density detection unit.

BRIEF DESCRIPTION OF THE DRAWINGS

Exemplary embodiment(s) of the present invention will be described in detail based on the following figures, wherein:

FIG. 20 is a table illustrating determination results of the image forming apparatus according to the first exemplary embodiment of the present invention.

DETAILED DESCRIPTION

Exemplary embodiments of the present invention will be described hereinafter with reference to the drawings.

First Exemplary Embodiment

Figure 2:
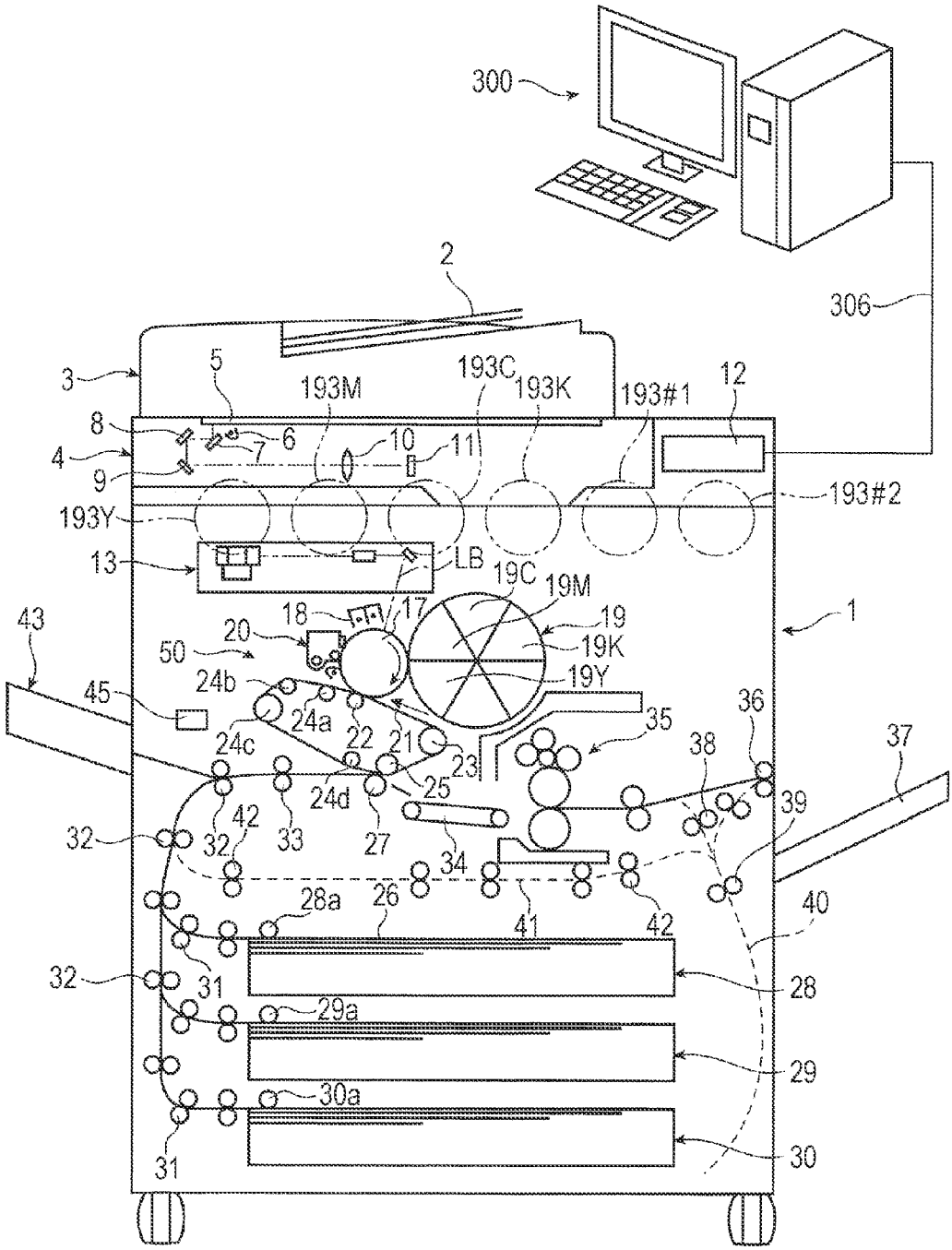
FIG. 2 illustrates the image forming apparatus according to the first exemplary embodiment of the present invention.

FIG. 2 schematically illustrates a four-cycle color image forming apparatus which may be an image forming apparatus according to a first exemplary embodiment of the present invention. The color image forming apparatus includes an image reading device, and may function as a full-color copying machine or a facsimile machine. The color image forming apparatus may also function as a printer that forms an image based on image data output from a personal computer or the like (not illustrated). As illustrated in FIG. 2, the image forming apparatus is connected to a personal computer 300 serving as a control device through a communication line 306, and is configured to form an image based on image data output from the personal computer 300. The image forming apparatus is also configured to adjust image quality in accordance with a control signal output from the personal computer 300.

In FIG. 2, an image forming apparatus body 1 includes in its upper portion an automatic document transport device 3 and an image reading device 4. The automatic document transport device 3 automatically transports originals 2 separately, one by one, to the image reading device 4. The image reading device 4 reads an image of an original 2 transported by the automatic document transport device 3. In the image reading device 4, an original 2 placed on a platen glass 5 is irradiated with light emitted by a light source 6, and a light image reflected from the original 2 is scanned and exposed onto an image reading element 11 including a charge-coupled device (CCD) sensor through a reduction optical system including a full-rate mirror 7, half-rate mirrors 8 and 9, and an imaging lens 10. The image reading element 11 reads the image of the original 2 in a predetermined dot density.

The image of the original 2 which has been read by the image reading device 4 is sent to an image processing device 12 as, for example, image data of three colors, e.g., red (R), green (G), and blue (B) (8 bits for each color). The image processing device 12 performs predetermined image processing, such as shading correction, misalignment correction, brightness/color space conversion, gamma correction, frame erase, and color/movement edition, on the image data of the original 2, as desired, to obtain image data of four colors, e.g., yellow (Y), magenta (M), cyan (C), and black (K).

The image data subjected to the predetermined image processing described above by the image processing device 12 is sequentially sent to an image exposure device 13 as image data corresponding to four colors including yellow (Y), magenta (M), cyan (C), and black (K). The image exposure device 13 performs image exposure using laser beams in accordance with the image data. The image forming apparatus may also function as a printer. When the image forming apparatus functions as a printer, image data is input to the image processing device 12 from a host computer 300 such as a personal computer, and the image processing device 12 performs predetermined image processing, as desired. After that, image data corresponding to four colors is sequentially output to the image exposure device 13.

The image forming apparatus according to the first exemplary embodiment is implemented only as the image forming apparatus body 1, by way of example, but may be implemented as an image forming system including the image forming apparatus body 1 and a control device such as the host computer 300.

The image forming apparatus body 1 includes an image forming unit 50 configured to sequentially form plural toner images having different colors. The image forming unit 50 generally includes a photoconductor drum 17, a scorotron charging device 18, the image exposure device 13, a rotary developing device 19, and a cleaning device 20. The photoconductor drum 17 serves as an image holding member that holds a toner image. The scorotron charging device 18 is one type of corona charging device having a grid electrode, which is an example of a charger that charges the surface of the photoconductor drum 17 at a predetermined potential. The image exposure device 13 serves as an electrostatic latent image forming unit that forms an electrostatic latent image in accordance with image data by performing image exposure on the surface of the photoconductor drum 17. The rotary developing device 19 serves as a developing unit that sequentially develops the electrostatic latent image formed on the surface of the photoconductor drum 17 using plural toners of different colors to form plural toner images of different colors. The cleaning device 20 serves as a cleaner that cleans the surface of the photoconductor drum 17. The charger 18 is not limited to a corona charging device and may be a roller-shaped charging member.

Figure 3:
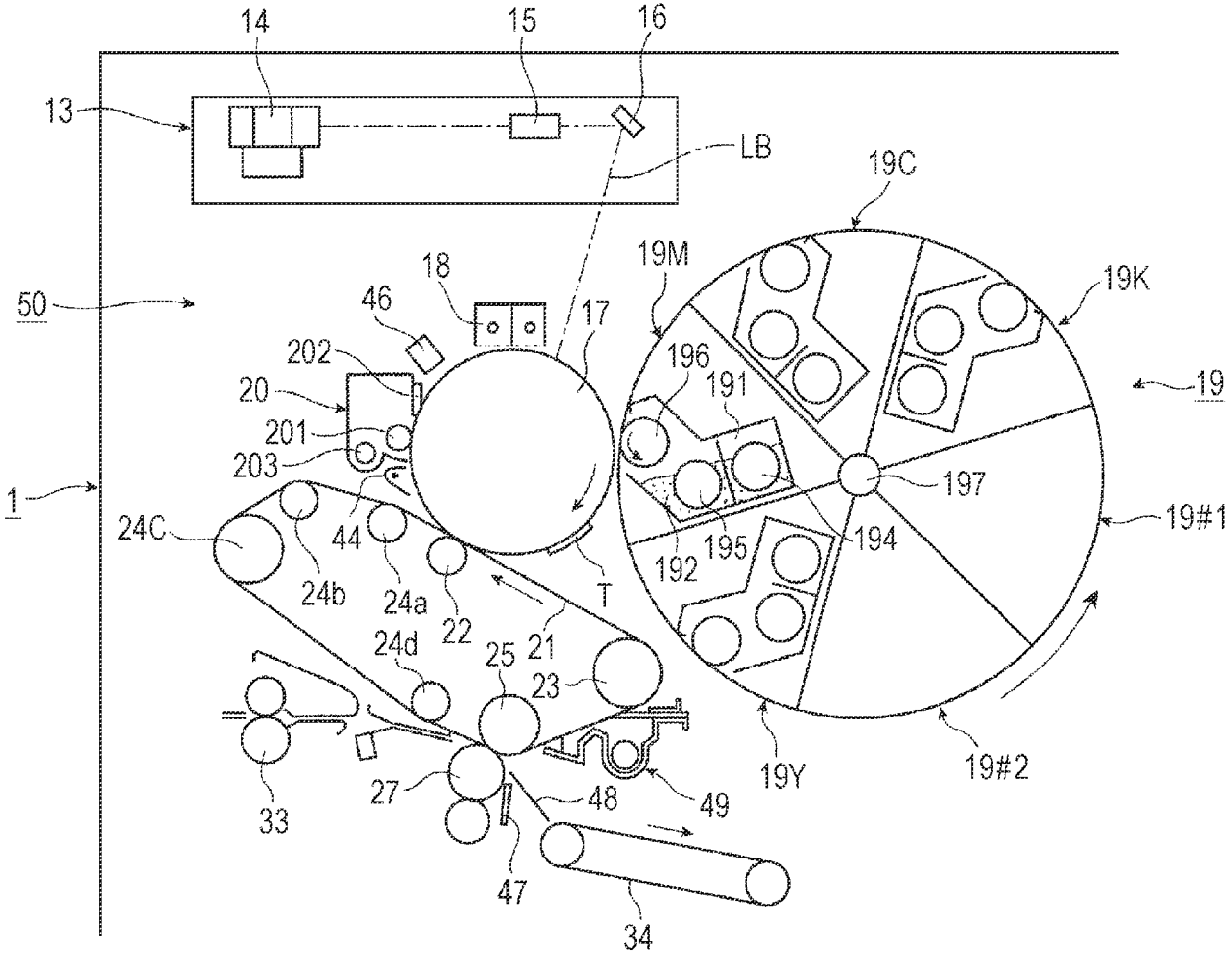
FIG. 3 illustrates an image forming unit of the image forming apparatus according to the first exemplary embodiment of the present invention.

As illustrated in FIG. 3, the image exposure device 13 modulates a semiconductor laser (not illustrated) in accordance with image data, and the semiconductor laser emits a laser beam LB in accordance with the image data. The laser beam LB emitted from the semiconductor laser is polarized and scanned by a rotating polygon mirror 14, and is scanned and exposed onto the surface of the photoconductor drum 17 serving as an image holding member through an f·θ lens 15 and a reflecting mirror 16.

As illustrated in FIG. 2, the photoconductor drum 17 onto which the laser beam LB is scanned and exposed by the image exposure device 13 is driven by a driver (not illustrated) to rotate in a direction indicated by an arrow at a predetermined speed (plural speeds, for example, 270 mm/sec, 110 mm/sec, etc.).

The surface of the photoconductor drum 17 is charged to a predetermined polarity (for example, negative polarity) and potential by the scorotron charging device 18 for first charging. After that, the laser beam LB is scanned and exposed in accordance with the image data to form an electrostatic latent image on the surface of the photoconductor drum 17 in accordance with the image data. The electrostatic latent image formed on the photoconductor drum 17 is reversely developed with, for example, toner charged to a negative polarity which is the same as the charging polarity of the photoconductor drum 17, by causing one developing unit of the rotary developing device 19 rotatably provided with developing units 19Y, 19M, 19C, and 19K of four colors including yellow (Y), magenta (M), cyan (C), and black (K) to move to a developing position facing the photoconductor drum 17, and becomes a toner image having a predetermined color. The rotary developing device 19 may include, in addition to the developing units 19Y, 19M, 19C, and 19K of four colors including yellow (Y), magenta (M), cyan (C), and black (K), up to two auxiliary developing units 19#1 and 19#2 corresponding to, for example, transparent toner (CT), light magenta (LM), light cyan (LC), etc. In this case, image data corresponding to transparent toner (CT), light magenta (LM), and light cyan (LC), etc. is generated by the image processing device 12.

As illustrated in FIG. 2, the toner images of the respective colors such as yellow (Y), magenta (M), cyan (C), and black (K) which are to be sequentially formed on the photoconductor drum 17 are subjected to first transfer by a first transfer roller 22 serving as a first transfer unit so that the toner images are transferred in a superimposed manner onto an intermediate transfer belt 21 which may be an endless belt serving as an intermediate transfer body disposed below the photoconductor drum 17. The intermediate transfer belt 21 functions as an image holding member that holds the toner images transferred from the photoconductor drum 17. The intermediate transfer belt 21 is stretched over a driving roller 23, a first driven roller 24*a*, a second driven roller 24*b*, a tension applying roller 24*c*, a third driven roller 24*d*, and a counter roller 25 that is part of a second transfer unit, and is circularly driven in a direction indicated by an arrow at a speed substantially equal to the rotation speed of the photoconductor drum 17.

Toner images of all or some of the four colors including yellow (Y), magenta (M), cyan (C), and black (K) which are to be subsequently formed on the photoconductor drum 17 are transferred onto the intermediate transfer belt 21 by the first transfer roller 22 so as to be sequentially superimposed on one another in accordance with the color of the image to be formed last. The toner images transferred onto the intermediate transfer belt 21 are subjected to second transfer by a second transfer roller 27 serving as a second transfer unit so that the toner images are collectively transferred onto recording paper 26 serving as a recording medium transported to a second transfer position at a predetermined timing by the counter roller 25 that supports the intermediate transfer belt 21 and by the second transfer roller 27 that is pressed against the counter roller 25 via the intermediate transfer belt 21. As illustrated in FIG. 2, the recording paper 26 is of the desired size and material and is fed from one of plural paper feed cassettes 28, 29, and 30 disposed in a lower portion of the image forming apparatus body 1 by paper feed rollers 28*a*, 29*a*, and 30*a*. In addition to plain paper, thick paper, coated paper, thin paper, or any other paper of the desired material may be fed from the plural paper feed cassettes 28, 29, and 30.

The recording paper 26, such as plain paper, thick paper, coated paper, or thin paper, is classified by basis weight. The fed recording paper 26 is transported to the second transfer position of the intermediate transfer belt 21 at a predetermined timing by plural transport rollers 31 and 32 and a registration roller 33. Then, as described above, toner images of predetermined several colors are collectively transferred (second transfer) onto the recording paper 26 by the counter roller 25 and the second transfer roller 27 from the intermediate transfer belt 21.

The recording paper 26 onto which toner images of predetermined several colors have been transferred (second transfer) from the intermediate transfer belt 21 is separated from the intermediate transfer belt 21, and is then transported to a fixing device 35 by a transport belt 34. The fixing device 35 fixes unfixed toner images onto the recording paper 26 by heat and pressure. In a one-sided or simplex copying operation, the recording paper 26 is discharged onto a paper output tray 37 as it is by a discharge roller 36, and an image forming process for forming a color image, a monochrome image, or the like ends.

The image forming apparatus is configured to form images on both sides, or a first side and a second side, of the recording paper 26. The image forming apparatus includes a transport unit for two-sided or duplex printing that turns over the recording paper 26 with toner images fixed onto the first side thereof by the fixing device 35 and that transports the recording paper 26 back to the second transfer unit.

Specifically, when the image forming apparatus is to form images on both sides of the recording paper 26, as illustrated in FIG. 2, the recording paper 26 with a color image or the like formed on the first side (front side) thereof is turned over face down by a reverse gate (not illustrated), without being discharged directly onto the paper output tray 37, so that the transport direction is changed, and is transported to a reverse path 40 by a transport roller 38 and a reverse roller 39. The recording paper 26 is then transported to a duplex printing path 41 by the reverse roller 39 that reverses, and is transported to the registration roller 33 by a transport roller 42 disposed in the duplex printing path 41. The recording paper 26 is transported again by the registration roller 33 in synchronization with the toner images on the intermediate transfer belt 21, and a process for transferring and fixing toner images onto the second side (back side) of the recording paper 26 is performed. After that, the recording paper 26 is delivered onto the paper output tray 37.

In this exemplary embodiment, the transport unit for duplex printing includes the transport roller 38, the reverse roller 39, the reverse path 40, the duplex printing path 41, and the transport roller 42. However, the transport unit for duplex printing is not limited to this configuration, and may be configured in any other way as long as a recording medium with a toner image fixed onto the first side thereof by a fixing unit is reversed and is transported back to the transfer unit.

In FIG. 2, a manual paper tray 43 is used to manually feed the recording paper 26 of desired size and material.

FIG. 3 illustrates the image forming unit 50 of the image forming apparatus.

In the image forming apparatus, as described above, the surface of the photoconductor drum 17 is charged uniformly to a predetermined polarity and potential by the scorotron charging device 18 for first charging. After that, the surface of the photoconductor drum 17 is sequentially exposed to light by the image exposure device 13 to sequentially create images corresponding to predetermined colors, and electrostatic latent images are formed.

Then, as described above, as illustrated in FIG. 3, the electrostatic latent images sequentially formed on the surface of the photoconductor drum 17 in accordance with the respective colors are developed by the developing units 19Y, 19M, 19C, and 19K of the corresponding colors, and a toner image T of a predetermined color is formed on the surface of the photoconductor drum 17.

In the rotary developing device 19, as illustrated in FIG. 3, the developing units 19Y, 19M, 19C, and 19K of the respective colors, that is, yellow (Y), magenta (M), cyan (C), and black (K), are arranged along the periphery of the rotary developing device 19. The rotary developing device 19 is rotated about a rotation axis 197 in the direction indicated by an arrow, and therefore developing rollers 196 in the developing units 19Y, 19M, 19C, and 19K of the corresponding colors are moved to and stopped at a developing position facing the photoconductor drum 17 so that the electrostatic latent images formed on the surface of the photoconductor drum 17 are developed by the desired colors of toner.

As illustrated in FIG. 3, each of the developing units 19Y, 19M, 19C, and 19K may be, for example, a two-component developing unit that accommodates two-component developer 192 including toner and carriers in a developing unit body 191. In the developing unit body 191, toner is supplied from toner cartridges 193Y to 193K (see FIG. 2) at predetermined timings so that the toner density in the developing unit body 191 is maintained within a predetermined range. The toner supplied into the developing unit body 191 is agitated with the developer 192 in the developing unit body 191 by two developer agitation transport augers 194 and 195 for frictional charging, and is circulated, during which the toner is supplied to the developing roller 196. In addition, the toner is transported to a developing region facing the surface of the photoconductor drum 17 as a magnetic brush of the developer 192 formed on the surface of the developing roller 196, and is used to develop the electrostatic latent image formed on the surface of the photoconductor drum 17.

For example, if the electrostatic latent image formed on the photoconductor drum 17 is an electrostatic latent image of yellow, the electrostatic latent image is developed by the developing unit 19Y of yellow, and a toner image T of yellow is formed on the photoconductor drum 17. Also for the other colors, i.e., magenta, cyan, and black, a similar process is performed to sequentially form toner images T of the corresponding colors on the photoconductor drum 17.

The toner images T of the respective colors sequentially formed on the photoconductor drum 17 are subjected to first transfer at a first transfer position where the photoconductor drum 17 and the intermediate transfer belt 21 are in contact with each other, and are transferred onto the front surface of the intermediate transfer belt 21 from the photoconductor drum 17. The first transfer roller 22 is disposed at the first transfer position on the back surface of the intermediate transfer belt 21. The intermediate transfer belt 21 is brought into contact with the surface of the photoconductor drum 17 by the first transfer roller 22. A voltage of polarity (positive polarity) opposite to the charging polarity of toner is applied to the first transfer roller 22, and the toner image T formed on the photoconductor drum 17 is transferred (first transfer) onto the intermediate transfer belt 21.

When a single-color image is to be formed, a toner image T of a predetermined color which has been transferred (first transfer) onto the intermediate transfer belt 21 is immediately transferred (second transfer) onto the recording paper 26 at a second transfer position. When a color image in which toner images T of plural colors are superimposed on one another is to be formed, the process of forming a toner image T of a predetermined color on the photoconductor drum 17 and performing first transfer to transfer the toner image T in a superimposed manner onto the intermediate transfer belt 21 is repeatedly performed a number of times equal to the number of predetermined colors.

For example, when a full-color image in which toner images T of four colors including yellow (Y), magenta (M), cyan (C), and black (K) are superimposed on one another is to be formed, every rotation allows a toner image T of each of the respective colors, i.e., yellow (Y), magenta (M), cyan (C), or black (K), to be sequentially formed on the photoconductor drum 17, and the toner images of the four colors are sequentially transferred (first transfer) onto the intermediate transfer belt 21 in such a manner that the toner images of the four colors are superimposed on one another.

As illustrated in FIG. 3, residual toner, an external additive of toner, or the like that remains without having been transferred (first transfer) from the photoconductor drum 17 onto the intermediate transfer belt 21 is subjected to charge removal by a pre-cleaning charge removing device 44, and is then cleaned by a cleaning device 20. The cleaning device 20 is configured to remove a residual material on the surface of the photoconductor drum 17, such as residual toner or an external additive of toner, by using a cleaning brush 201 and a cleaning blade 202, and to discharge the removed material such as toner to outside the cleaning device 20 at a predetermined timing by using a transport auger 203. The surface of the photoconductor drum 17 which has been cleaned by the cleaning device 20 is uniformly exposed to light by an erase lamp 46 to remove charge for the subsequent image forming process.

Figure 4:
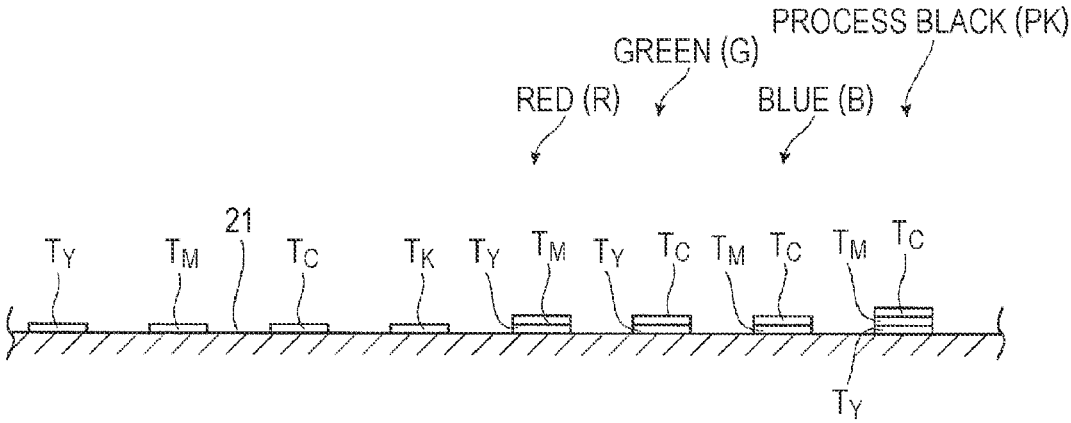
FIG. 4 illustrates a toner image held on an intermediate transfer belt.

The intermediate transfer belt 21 is rotated with a period synchronized with that of the photoconductor drum 17 while the unfixed toner image T of, for example, yellow which has been initially subjected to first transfer is being held on the intermediate transfer belt 21. As illustrated in FIG. 4, each time the intermediate transfer belt 21 is rotated, unfixed toner images $T_M$, $T_C$, and $T_K$ of magenta, cyan, and black are individually or sequentially transferred onto the intermediate transfer belt 21 in a manner of being superimposed on the unfixed toner image $T_Y$ of yellow.

Unfixed toner images T transferred (first transfer) onto the intermediate transfer belt 21 in the above manner are transported to the second transfer position facing the transport path of the recording paper 26 in accordance with the rotation of the intermediate transfer belt 21.

As illustrated in FIG. 2, as described above, the recording paper 26 is fed from the desired one of the paper feed cassettes 28, 29, and 30 by the paper feed roller 28*a*, 29*a*, or 30*a*, and is transported to the registration roller 33 by the transport rollers 31 and 32. The recording paper 26 is further fed to a pressing portion between the second transfer roller 27 and the intermediate transfer belt 21 by the registration roller 33 at a predetermined timing.

As illustrated in FIG. 3, the counter roller 25 serving as a counter electrode of the second transfer roller 27 is disposed on the back surface of the intermediate transfer belt 21 at the second transfer position. At the second transfer position, the second transfer roller 27 is always pressed against the intermediate transfer belt 21, or the second transfer roller 27 is pressed against the intermediate transfer belt 21 at a predetermined timing to apply a voltage of polarity opposite to the charging polarity of toner to the second transfer roller 27 or apply a voltage of polarity which is the same as the charging polarity of toner is applied to the counter roller 25. Therefore, the unfixed toner images T transferred onto the intermediate transfer belt 21 serving as a toner image holding member are collectively transferred (second transfer) onto the recording paper 26 at the second transfer position.

In FIG. 3, a belt cleaning device 49 cleans the front surface of the intermediate transfer belt 21. The belt cleaning device 49 is configured to be normally spaced apart from the front surface of the intermediate transfer belt 21, and to come into contact with the front surface of the intermediate transfer belt 21 at a predetermined timing.

As illustrated in FIG. 3, the recording paper 26 onto which the unfixed toner images T have been transferred is separated from the intermediate transfer belt 21, and is delivered to the fixing device 35 (see FIG. 2) by an electrode member 47, a guide plate 48, and a transport belt 34, which are disposed downstream of the second transfer unit, to fix the unfixed toner images T.

The intermediate transfer belt 21 may be formed of a film-shaped belt of synthetic resin such as polyimide or polyamideimide or various rubbers having an appropriate amount of conductive filler such as carbon black dispersed therein which is adjusted so as to have a volume resistivity of $10^6$ to $10^{14}$ Ω·cm. The thickness of the intermediate transfer belt 21 may be set to, for example, 0.1 mm. The perimeter of the intermediate transfer belt 21 may be set to an integer multiple (for example, twice to three times) of the perimeter of the photoconductor drum 17.

The second transfer roller 27 is disposed in contact with or spaced part from the intermediate transfer belt 21, as desired. When a color image is to be formed, the second transfer roller 27 is spaced apart from the intermediate transfer belt 21 until the unfixed toner image T of the last color has been transferred (first transfer) onto the intermediate transfer belt 21. The second transfer roller 27 may be kept in contact with or spaced apart from the intermediate transfer belt 21.

The second transfer roller 27 includes, for example, an elastic layer formed of polyurethane rubber or the like having an ion-conductivity conductive material dispersed therein. The second transfer roller 27 may be formed so as to have a volume resistivity of, for example, $10^3$ to $10^{10}$ Ω·cm, a roller diameter of ϕ28 mm, and a hardness of, for example, 30° (Asker C hardness).

The counter roller 25 includes an elastic layer formed of ethylene propylene diene monomer (EPDM) rubber having an ion-conductivity conductive material dispersed therein. The counter roller 25 may be formed so as to have a surface resistivity of, for example, $10^7$ to $10^{10}$Ω/□, a roller diameter of ϕ28 mm, and a hardness of, for example, 70° (Asker C hardness).

The electrode member 47 disposed downstream of am abutting portion at the second transfer position includes a conductive plate which is preferably formed of sheet metal. In this exemplary embodiment, a stainless steel plate having a thickness of 0.5 mm may be used, and the electrode member 47 may have a needle-shaped end on the recording paper 26 side. The tip of the electrode member 47 on the second transfer unit side may be disposed at, for example, a position that is 1 mm near the second transfer roller 27 with respect to a line defined by a nip part between the counter roller 25 and the second transfer roller 27 and that is 7 mm apart from the outlet of the nip part.

In the image forming apparatus having the above configuration, as illustrated in FIGS. 2 and 3, toner images T of respective colors such as yellow (Y), magenta (M), cyan (C), and black (K) are sequentially formed on the photoconductor drum 17 in accordance with the color of the image to be formed last. As illustrated in FIG. 4, the toner images T are individually or sequentially transferred (first transfer) onto the intermediate transfer belt 21 in a manner of being superimposed on one another. After that, the toner images T are collectively transferred (second transfer) onto the recording paper 26 from the intermediate transfer belt 21. Therefore, an image of the desired colors is formed.

For example, when a red image is to be formed, as illustrated in FIG. 4, a two-color toner image in which a yellow (Y) toner image $T_Y$ and a magenta (M) toner image $T_M$ are superimposed on one another is formed. When a green image is to be formed, a two-color toner image in which a yellow (Y) toner image $T_Y$ and a cyan (C) toner image $T_C$ are superimposed on one another is formed. When a blue image is to be formed, a two-color toner image in which a magenta (M) toner image $T_M$ and a cyan (C) toner image $T_C$ are superimposed on one another is formed.

Even when a black (K) image is to be formed, a single-color image formed of a single-color (one color) toner image $T_K$ of black (K) may be formed or, as illustrated in FIG. 4, a three-color toner image in which toner images $T_Y$, $T_M$, and $T_C$ of three colors including yellow (Y), magenta (M), and cyan (C) are superimposed on one another (called process black (PK)) may be formed in accordance with user specification or an image.

In this manner, an image to be held on the intermediate transfer belt 21 serving as an image holding member is any of various types of toner images such as, as illustrated in FIG. 4, an image formed of single-color (one color) toner images T of yellow (Y), magenta (M), cyan (C), and black (K), and multiple-color toner images such as a two-color toner image T in which yellow (Y) and magenta (M) are superimposed on one another, a two-color toner image T in which yellow (Y) and cyan (C) are superimposed on one another, a two-color toner image T in which magenta (M) and cyan (C) are superimposed on one another, and a three-color toner image T in which toner image T of three colors including yellow (Y), magenta (M), and cyan (C) are superimposed on one another. The toner images held on the intermediate transfer belt 21 are collectively transferred (second transfer) onto the recording medium 26 by the second transfer roller 27, and are fixed onto the recording medium 26 by the fixing device 35.

FIG. 4 illustrates toner images transferred (first transfer) onto the intermediate transfer belt 21 in a superimposed manner. The toner images collectively transferred (second transfer) onto the recording medium 26 from the intermediate transfer belt 21 are configured such that the stacked toner images of the respective colors are flipped upside down.

Figure 5:
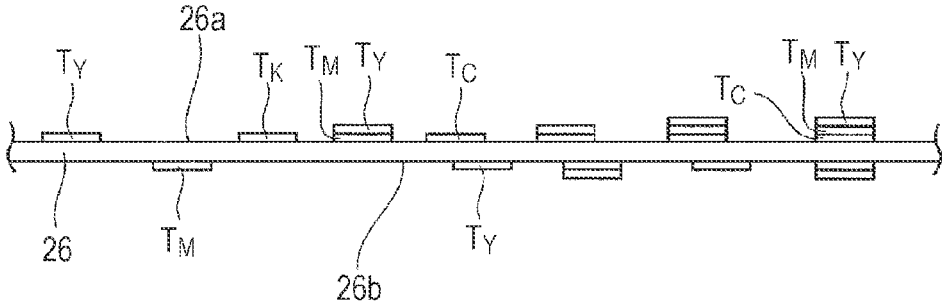
FIG. 5 schematically illustrates a toner image formed on recording paper.

As illustrated in FIG. 2, the image forming apparatus is configured to form images on both sides of the recording paper 26 by transferring and fixing an image onto a first side (front side) 26*a* of the recording paper 26, reversing the recording paper 26, transporting the recording paper 26 in a reversed state back to the second transfer position, and transferring and fixing an image onto a second side (back side) 26*b* of the recording paper 26. When the recording paper 26 with an image transferred and fixed onto the first side (front side) thereof passes through the second transfer position again, as illustrated in FIG. 5, the image has already been transferred and fixed onto the first side (front side) 26*a* of the recording paper 26. The transfer settings under which an image is subjected to second transfer and transferred onto the second side (back side) 26*b* of the recording paper 26 may be different from those under which an image is transferred onto the first side (front side) 26*a* of the recording paper 26.

As illustrated in FIG. 5, toner images formed on the first side (front side) 26*a* of the recording paper 26 may not overlap toner images formed on the second side (back side) 26*b* of the recording paper 26 or some or all the toner images formed on the first side (front side) 26*a* of the recording paper 26 may overlap toner images formed on the second side (back side) 26*b* of the recording paper 26. Even when toner images formed on the first side (front side) 26*a* overlaps toner images formed on the second side (back side) 26*b*, various situations may be available: single-color toner images overlap, a single-color toner image and a multiple-color toner image overlap, and multiple-color toner images overlap. The transfer settings under which toner images are collectively transferred (second transfer) onto the recording medium 26 from the intermediate transfer belt 21 may differ depending on the state where toner images are formed.

Figure 1:
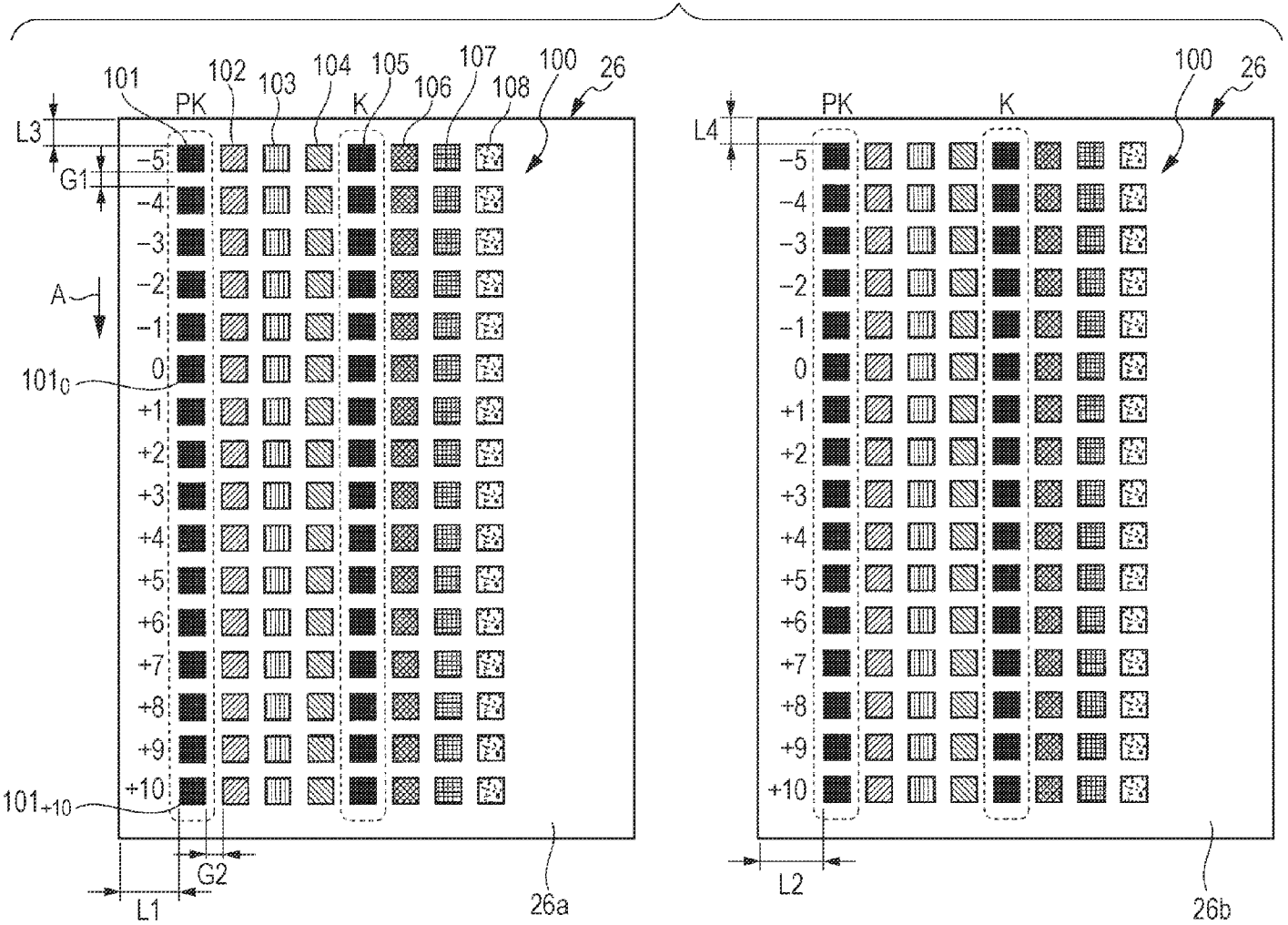
FIG. 1 illustrates a transfer-performance-detection toner image for an image forming apparatus according to a first exemplary embodiment of the present invention.

In this exemplary embodiment, a special transfer-performance-detection toner image 100 illustrated in FIG. 1 is used as a toner image for detecting the transfer performance or the image forming apparatus. The transfer-performance-detection toner image 100 has on a first side (front side) 26*a* thereof, for example, A3-size recording paper 26, for example, three-color toner images (process K) 101 having a density of 100% in which toner images T of three colors including yellow (Y), magenta (M), and cyan (C) are superimposed on one another, two-color red toner images 102 having a density of 100% in which yellow (Y) toner images $T_Y$ and magenta (M) toner images $T_M$ are superimposed on one another, two-color green toner images 103 having a density of 100% in which yellow (Y) toner images $T_Y$ and cyan (C) toner images $T_C$ are superimposed on one another, two-color blue toner images 104 having a density of 100% in which magenta (M) toner images $T_M$ and cyan (C) toner images $T_C$ are superimposed on one another, single-color toner images 105 of black (K) having a density of 100%, single-color toner images 106 of magenta (M) having a density of 60%, single-color toner images 107 of cyan (C) having a density of 60%, and toner images 108 of black (K) having a density of 60%.

The recording paper 26 having the transfer-performance-detection toner image 100 formed thereon is not limited to the recording paper 26 of A3 size. Any number of sheets of recording paper 26 of any size may be used. For example, the transfer-performance-detection toner image 100 may be formed on plural, such as two, sheets of recording paper 26 of A4 size.

As illustrated in FIG. 1, the toner images 101 to 108 of the respective colors may be formed in square shapes each having sides of 10 to 20 mm, and are arranged in a vertical and lateral directions with predetermined intervals G1 and G2 (in FIG. 1, by way of example, G1=G2). However, the present invention is not limited to this example, and the toner images 101 to 108 may be formed in any shape, such as a rectangular shape, of any size with any intervals.

As illustrated in FIG. 1, when toner images formed on the intermediate transfer belt 21 are transferred onto the recording paper 26, a transfer voltage to be applied to the second transfer roller 27 is changed in a transport direction A of the recording paper 26 with respect to a standard transfer voltage $V_0$ that is determined automatically in accordance with the thickness and the like of the recording paper 26, in plural levels (in FIG. 1, by way of example, 16 levels) in the negative and positive directions over every set of toner images 101 to 108 formed in a direction intersecting the transport direction of the intermediate transfer belt 21. In this state, the toner images of the respectively colors are transferred (second transfer) onto the recording paper 26 from the intermediate transfer belt 21.

Figure 6:
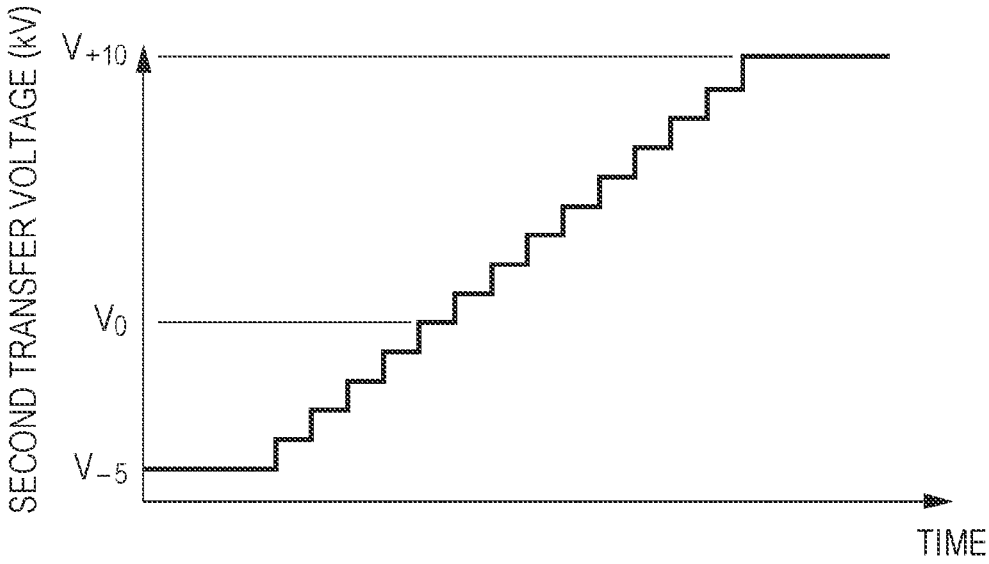
FIG. 6 is a graph illustrating a transfer voltage.

In this exemplary embodiment, as illustrated in FIG. 6, when the standard transfer voltage $V_0$ is set to the index "0", a transfer voltage $V_{2nd}$ to be applied to the second transfer roller 27 is incrementally changed by five levels in the negative direction to a transfer voltage $V_{-5}$ by decreasing the standard transfer voltage $V_0$ in steps of 10%, and is also incrementally changed by ten levels in the positive direction to a transfer voltage $V_{+10}$ (a total of 16 levels) by increasing the standard transfer voltage $V_0$ in steps of 10%. The transfer voltage $V_{2nd}$ to be applied to the second transfer roller 27 may not necessarily be incrementally changed by 16 levels in increments of 10%, and may be incrementally increased by more or less than 16 levels in steps of more or less than 10%. Additionally, the transfer voltage $V_{2nd}$ may not necessarily be changed in equal increments.

Figure 7:
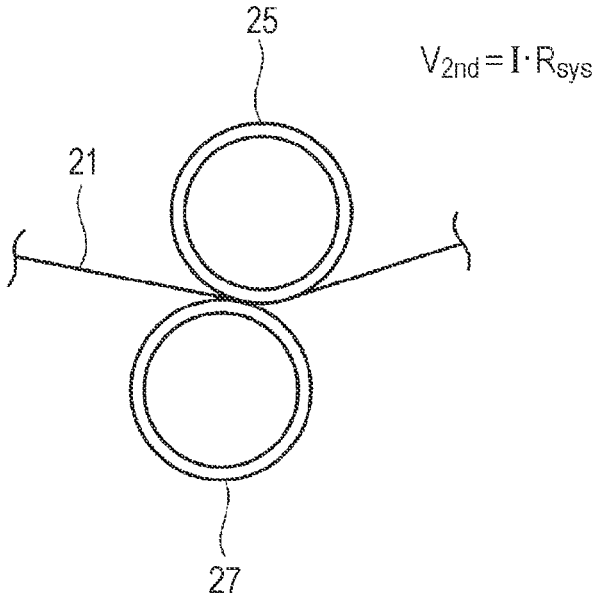
FIG. 7 illustrates a second transfer unit.

As illustrated in FIG. 7, the transfer voltage $V_{2nd}$ to be applied to the second transfer roller 27 is determined by the system resistance $R_{SYS}$ and transfer current I of a second transfer unit including the counter roller 25, the intermediate transfer belt 21, and the second transfer roller 27.

Consequently, in this exemplary embodiment, as illustrated in FIG. 1, eight types of toner images with transfer voltages of 16 levels, that is, a total of 128 toner images, namely, process K toner images $\mathbf{101}_{-5}$ to $\mathbf{101}_{+10}$ having a density of 100%, red toner images $\mathbf{102}_{-5}$ to $\mathbf{102}_{+10}$ having a density of 100%, green toner images $\mathbf{103}_{-5}$ to $\mathbf{103}_{+10}$ having a density of 100%, blue toner images $\mathbf{104}_{-5}$ to $\mathbf{104}_{+10}$ having a density of 100%, black (K) toner images $\mathbf{105}_{-5}$ to $\mathbf{105}_{+10}$ having a density of 100%, magenta (M) toner images $\mathbf{106}_{-5}$ to $\mathbf{106}_{+10}$ having a density of 60%, cyan (C) toner images $\mathbf{107}_{-5}$ to $\mathbf{107}_{+10}$ having a density of 60%, and black (K) toner images $\mathbf{108}_{-5}$ to $\mathbf{108}_{+10}$ having a density of 60%, are formed on the first side (front side) 26*a* of the A3 size recording paper 26.

As illustrated in FIG. 1, furthermore, a total of 128 toner images, the number of which is equal to the number of toner images formed on the first side (front side) 26*a* of the recording paper 26, namely, the toner images $\mathbf{101}_{-5}$ to $\mathbf{101}_{+10}$, $\mathbf{102}_{-5}$ to $\mathbf{102}_{+10}$, $\mathbf{103}_{-5}$ to $\mathbf{103}_{+10}$, $\mathbf{104}_{-5}$ to $\mathbf{104}_{+10}$, $\mathbf{105}_{-5}$ to $\mathbf{105}_{+10}$, $\mathbf{106}_{-5}$ to $\mathbf{106}_{+10}$, $\mathbf{107}_{-5}$ to $\mathbf{107}_{+10}$, $\mathbf{108}_{-5}$ to $\mathbf{108}_{+10}$, are formed on the second side (back side) 26*b* of the recording paper 26. In this regard, the 128 toner images formed on the second side (back side) 26*b* of the recording paper 26 are formed in a direction intersecting the movement direction of the intermediate transfer belt 21, which is a main scanning direction, with a displacement which is half the width of one toner image with respect to the toner images formed on the first side (front side) 26*a* of the recording paper 26.

Figure 8A:
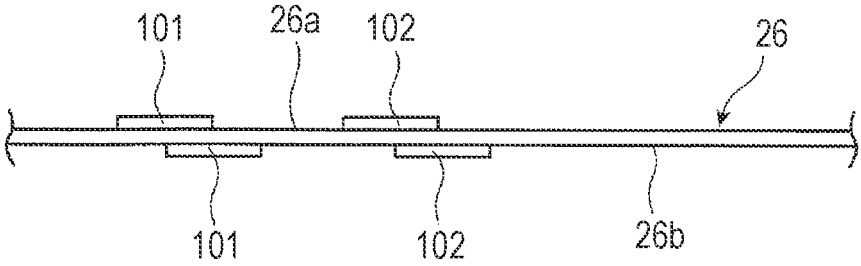
FIGS. 8A and 8B schematically illustrate toner images formed on recording paper.

Therefore, as illustrated in FIG. 8A, the toner images formed on the first side (front side) 26*a* of the recording paper 26 and the toner images formed on the second side (back side) 26*b* of the recording paper 26 overlap by an amount equal to half the width of one toner image. The toner images formed on the first side (front side) 26*a* of the recording paper 26 and the toner images formed on the second side (back side) 26*b* of the recording paper 26 do not overlap by an amount equal to half the width of one toner image, and are formed independent manner.

When the toner images formed on the first side (front side) 26*a* of the recording paper 26 and the toner images formed on the second side (back side) 26*b* of the recording paper 26 are formed with a displacement which is half the width of one toner image in the manner described above, a space for forming plural toner images may be reduced by an amount by which the toner images overlap, which is preferable.

Figure 8B:
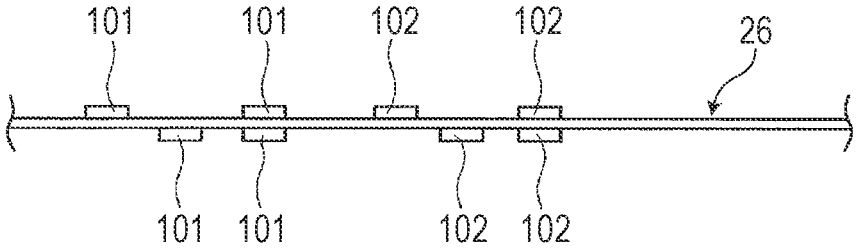

However, the toner images formed on the first side (front side) 26*a* of the recording paper 26 and the toner images formed on the second side (back side) 26*b* of the recording paper 26 may not necessarily be formed with a displacement which is half the width of one toner image. As illustrated in FIG. 8B, images in which toner images formed on the first side (front side) of the recording paper 26 and toner images formed on the second side (back side) of the recording paper 26 completely overlap, and images in which toner images formed on the first side (front side) of the recording paper 26 and toner images formed on the second side (back side) of the recording paper 26 do not completely overlap may be separately formed. The amount of displacement is not limited to half the width of one toner image, and may be set to any other value.

The toner images formed on the first side (front side) 26*a* of the recording paper 26 and the toner images formed on the second side (back side) 26*b* of the recording paper 26 are formed with equal predetermined intervals G1 and G2 in the longitudinal direction of the recording paper 26 (the movement direction of the intermediate transfer belt 21) and the lateral direction of the recording paper 26 (the direction intersecting the movement direction of the intermediate transfer belt 21). In this case, the toner images formed on the second side (back side) 26*b* of the recording paper 26 are formed with a displacement with respect to the toner images formed on the first side (front side) 26*a* of the recording paper 26 so that a write start position L2 is larger than a write start position L1 by half the width of one toner image in the lateral direction of the toner images (the direction intersecting the movement direction of the intermediate transfer belt 21).

In this exemplary embodiment, furthermore, as illustrated in FIG. 2, the transport direction of the recording paper 26 is reversed by using the reverse path 40 to turn over or reverse the recording paper 26. The leading end of the first side (front side) of the recording paper 26 and the leading end of the second side (back side) of the recording paper 26 travel in opposite directions. For this reason, in this exemplary embodiment, as illustrated in FIG. 1, 128 toner images are formed on the first side (front side) 26*a* and the second side (back side) 26*b* of the recording paper 26 at positions L3 and L4 which are equal to both the leading end and trailing end of the recording paper 26. Therefore, toner images to be formed on the first side (front side) and second side (back side) of the recording paper 26 are located at equal positions in the transport direction of the recording paper 26 (i.e., L3=L4) and overlap.

Further, the positions of the toner images to be formed on the first side (front side) 26*a* and second side (back side) 26*b* of the recording paper 26 in the direction (main scanning direction) crossing the transport direction of the recording paper 26 are set by shifting the timing when the image exposure device 13 starts image exposure by a time corresponding to half the width of one toner image.

Figure 9:
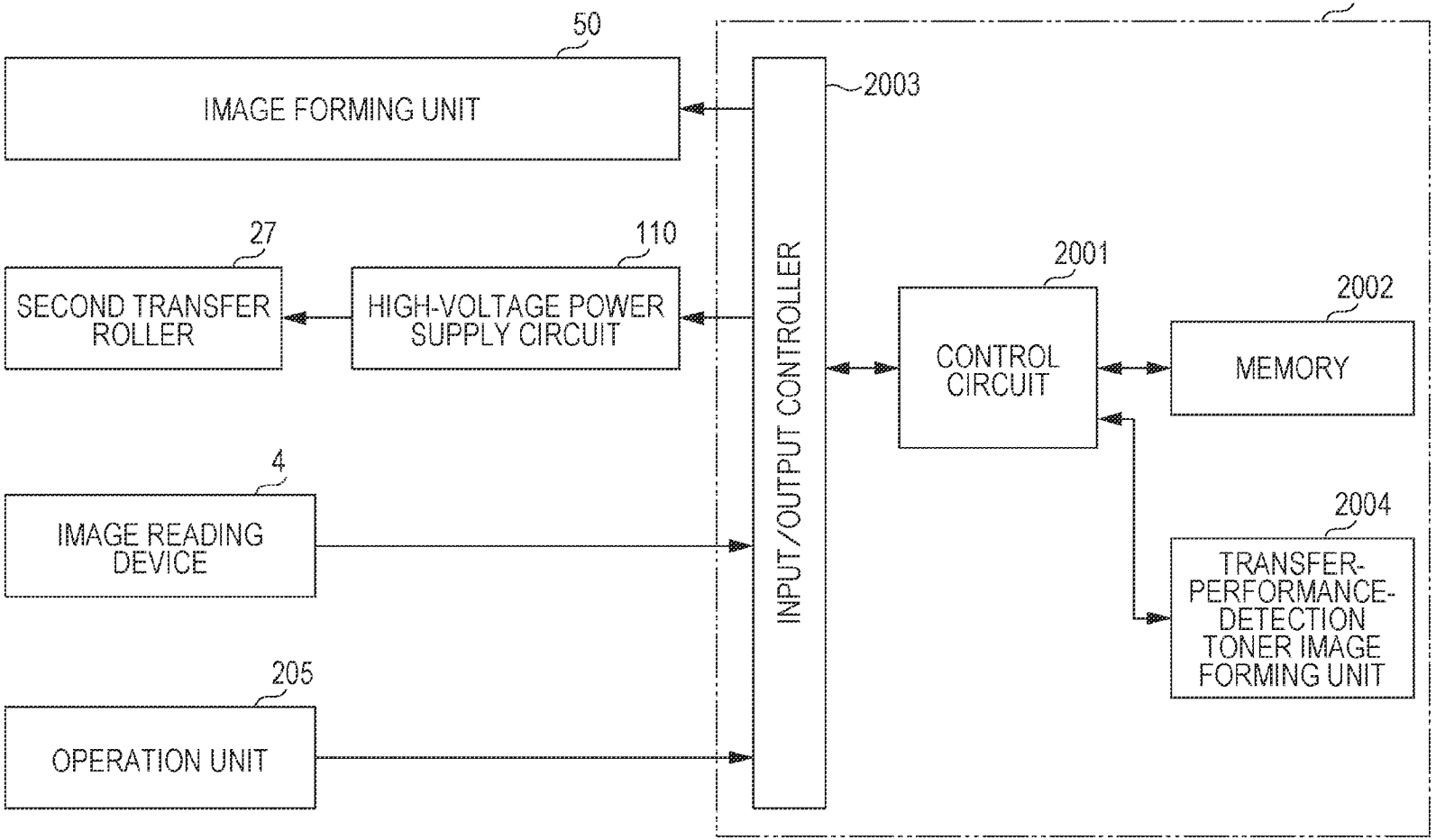
FIG. 9 is a block diagram illustrating a control device for the image forming apparatus.

FIG. 9 is a block diagram illustrating a control circuit of the image forming apparatus according to this exemplary embodiment.

In FIG. 9, a control device 2000 controls the operation of the image forming apparatus. The control device 2000 includes a control circuit 2001, such as a central processing unit (CPU), that controls the operation of the image forming apparatus, a memory 2002 that stores a program, parameters, etc., for controlling the operation of the image forming apparatus, an input/output controller 2003 that controls the input and output of signals, and a transfer-performance-detection toner image forming unit 2004 that is configured to form the transfer-performance-detection toner image 100 and that stores image data. The transfer-performance-detection toner image forming unit 2004 includes image data stored to form, for example, the transfer-performance-detection toner image 100 illustrated in FIG. 1.

As illustrated in FIG. 9, the control circuit 2001 is configured to control the image forming unit 50 through the input/output controller 2003, and is also configured to perform constant voltage control through a high-voltage power supply circuit 110 to control a transfer voltage to be applied to the second transfer roller 27 to predetermined plural values.

As illustrated in FIG. 9, furthermore, the image data read by the image reading device 4 is input to the control circuit 2001 through the input/output controller 2003, and is temporarily stored in the memory 2002. In addition, user setting data such as the size of the recording paper 26 and the number of sheets to be printed, which is input from an operation unit 205 having a function of a selector, is also input to the control circuit 2001 through the input/output controller 2003.

Figure 10:
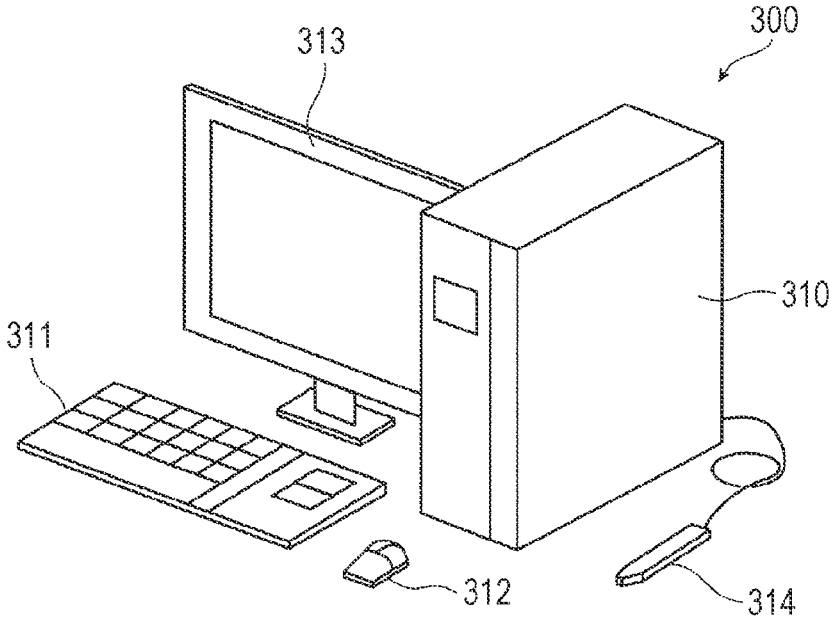
FIG. 10 is a perspective view illustrating a personal computer.

FIG. 10 illustrates a personal computer 300 that functions as a control device in an image forming system according to a modification of the exemplary embodiment which includes, as illustrated in FIG. 2, the image forming apparatus body 1 and the control device 300 such as a personal computer.

Figure 11:
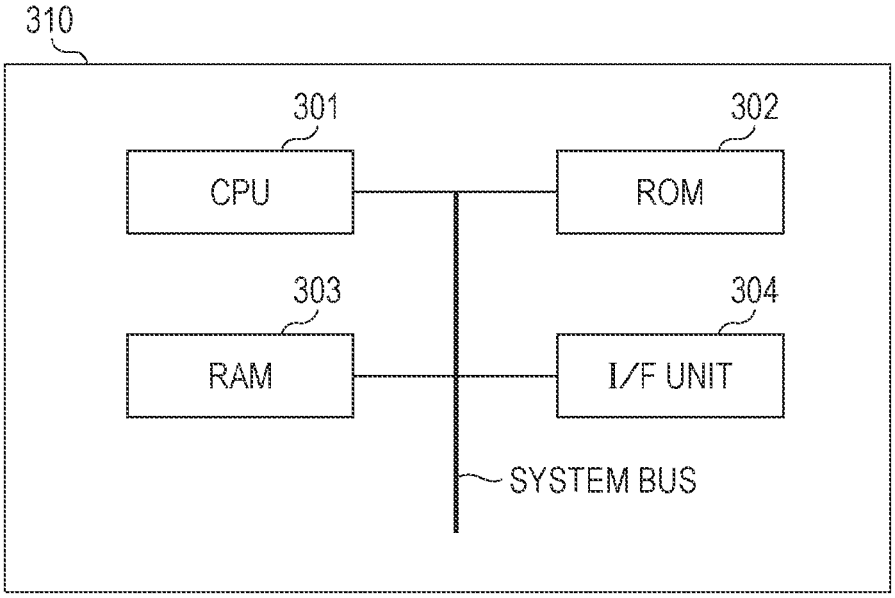
FIG. 11 is a block diagram illustrating the personal computer.

As illustrated in FIG. 10, the personal computer 300 includes, for example, a personal computer body 310, a keyboard 311 and a mouse 312 that are used to operate the personal computer 300 and that also function as a selector, and a liquid crystal display device 313 serving as a display. As illustrated in FIG. 11, the personal computer body 310 includes a CPU 301, a read-only memory (ROM) 302, a random access memory (RAM) 303, an interface (I/F) unit 304, and a system bus 305 that connects the CPU 301, the ROM 302, the RAM 303, and the interface unit 304 to one another.

As illustrated in FIG. 10, the personal computer 300 further includes a pen-shaped manual colorimeter 314 connected to the personal computer body 310 via a universal serial bus (USB) terminal or the like. The manual colorimeter 314 is used to read an image on the recording paper 26 on which the transfer-performance-detection toner image 100 is formed by, for example, the L*a*b* color system.

The CPU 301 is configured to control the overall operation of the personal computer 300 via the system bus 305. The ROM 302 is configured to store a program for the CPU 301. Examples of the program stored in the ROM 302 according to this exemplary embodiment include a program for providing functions corresponding to those of an operating system, and a program serving as a printer driver that controls the image forming apparatus body 1 which functions as a printer. The RAM 303 may be formed of, for example, a static RAM (SRAM), and is configured to store a program control variable, data for performing various processes, etc.

The interface unit 304 is configured to communicate with an external device such as the image forming apparatus body 1.

In the above configuration, the image forming apparatus according to this exemplary embodiment is configured to adjust the image transfer performance as follows when single-color images or multiple-color images are formed on both sides of a recording medium.

Figure 12A:
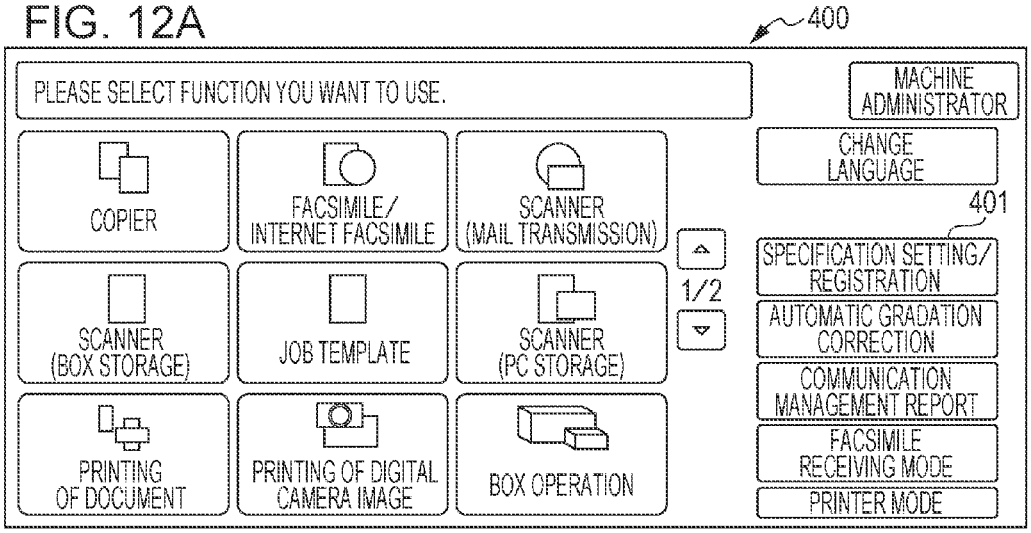
FIGS. 12A to 12C illustrate a display.
Figure 12B:
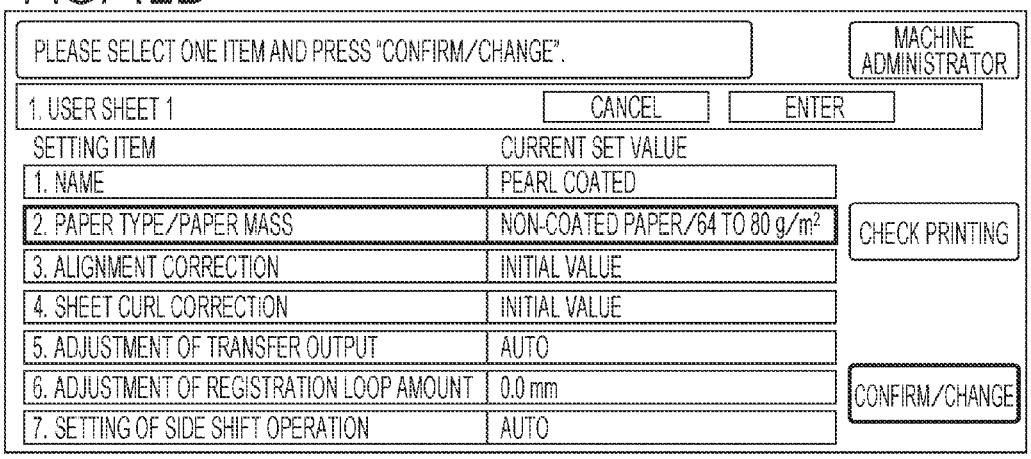
Figure 12C:
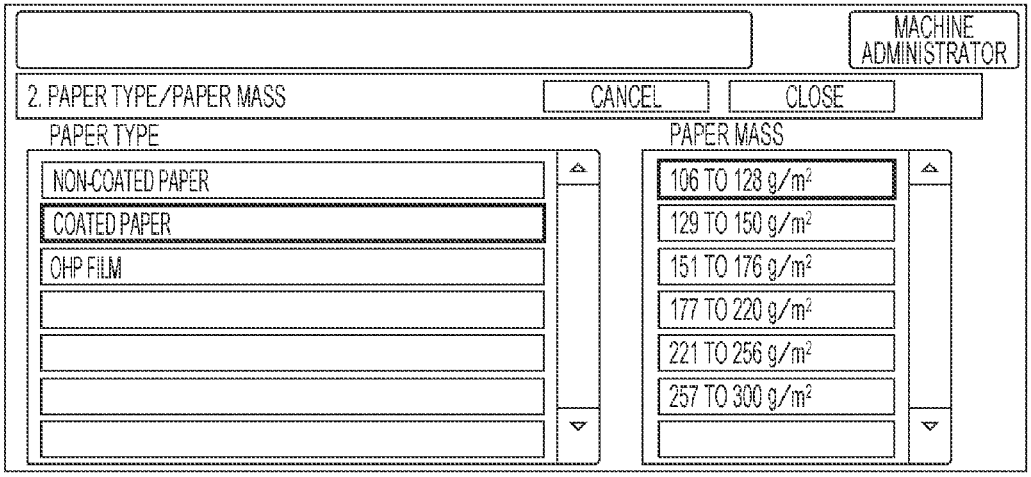

Specifically, in the image forming apparatus according to this exemplary embodiment, for example, a user or a service engineer operates the operation unit 205 illustrated in FIG. 9, which serves as a user interface, to display a display screen 400 of the operation unit 205 illustrated in FIG. 12A, and presses a "Specification setting/registration" button in a machine administrator mode on the display screen 400 to select, as illustrated in FIGS. 12B and 12C, the type and mass of the recording paper 26 to be used by the user for the evaluation of transfer performance. The type of the recording paper 26 to be used by the user, for example, non-coated paper or coated paper, and the mass of paper, for example, 64 to 80 $g/m^2$ for non-coated paper, or 106 to 128 $g/m^2$, 129 to 150 $g/m^2$, or 151 to 176 $g/m^2$ for coated paper, are input and set.

Figure 13A:
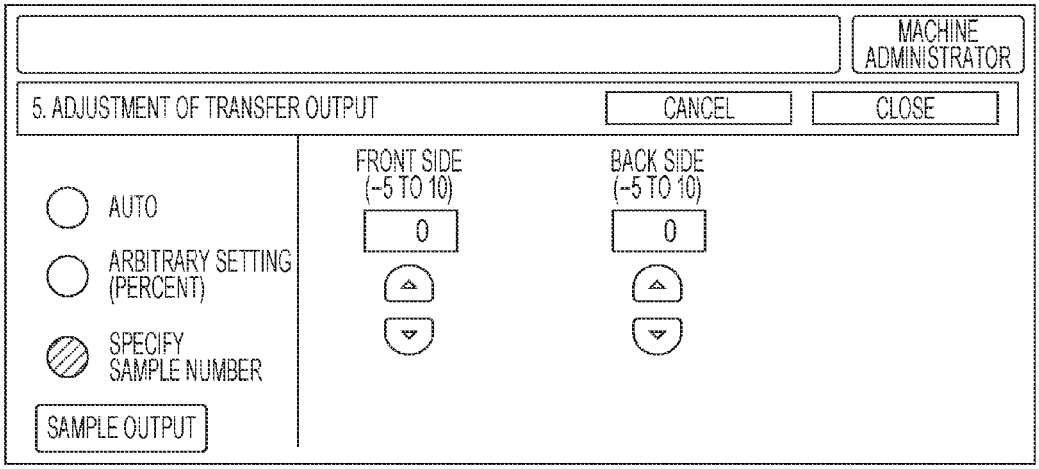
FIGS. 13A to 13C illustrate a display.
Figure 13B:
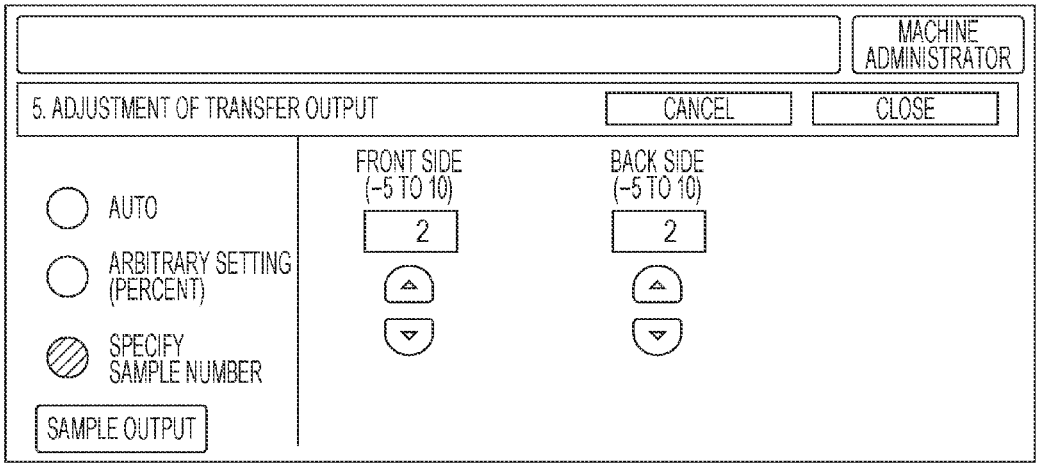

Then, as illustrated in FIGS. 13A and 13B, the operation unit 205 is operated for adjusting the transfer output to output the transfer-performance-detection toner image 100, and values for changing the transfer voltage, etc. are input.

Figure 13C:
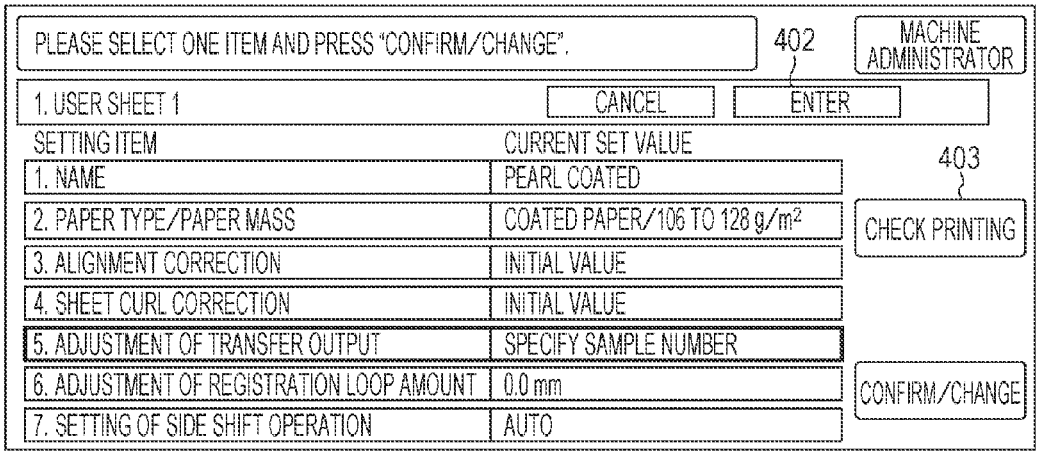

Finally, in the operation unit 205, as illustrated in FIG. 13C, all the setting items for outputting the transfer-performance-detection toner image 100 are set, and then an "Enter" button 402 is pressed. Thus, the setting operation for outputting the transfer-performance-detection toner image 100 on the recording paper 26 specified by the user ends.

Figure 14:
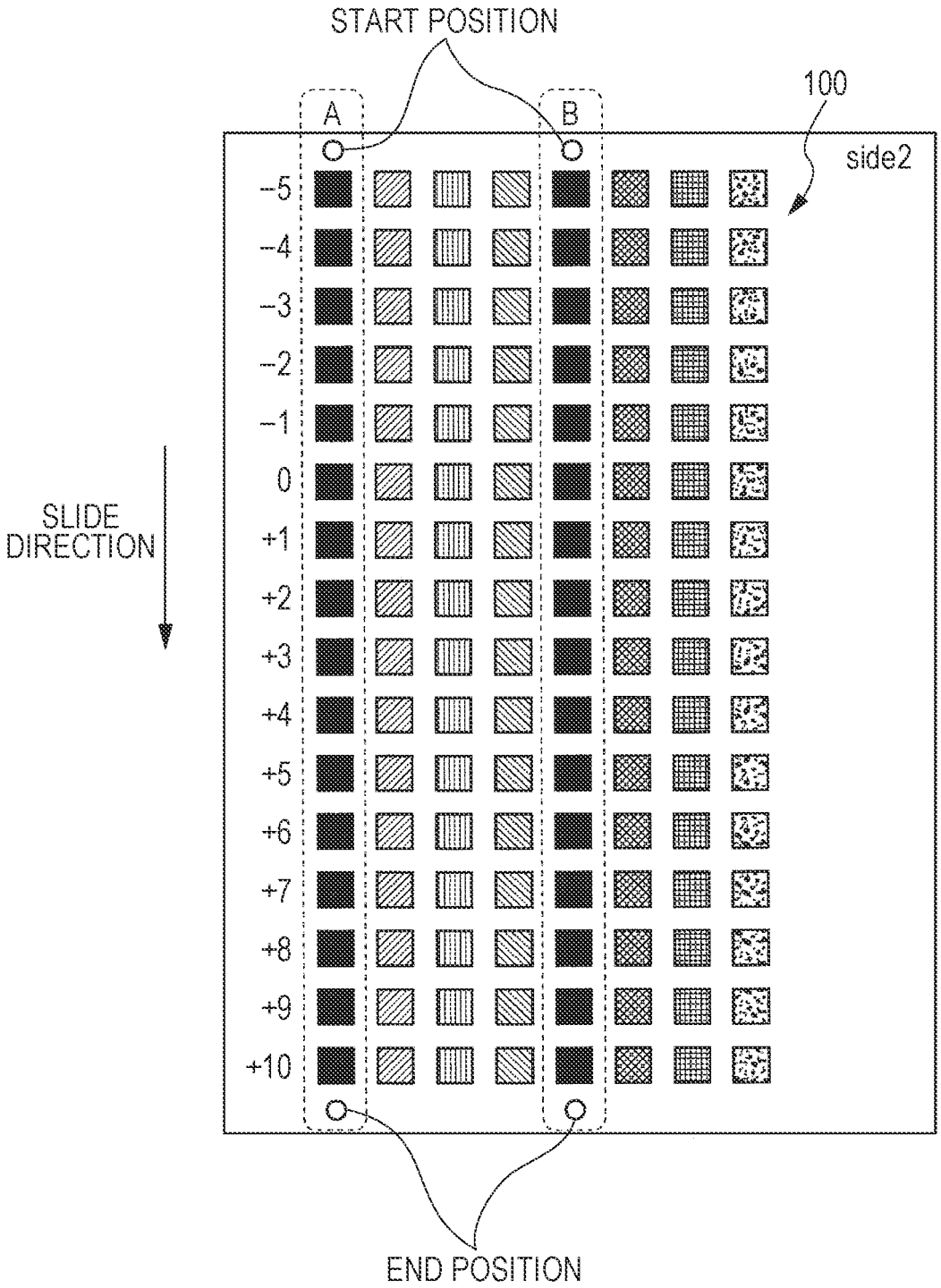
FIG. 14 illustrates a transfer-performance-detection toner image for the image forming apparatus according to the first exemplary embodiment of the present invention.

In addition, in the operation unit 205, as illustrated in FIG. 13C, when a "Check Printing" button 403 is operated, the image forming apparatus body 1 executes the operation of outputting the transfer-performance-detection toner image 100. Accordingly, a transfer-performance-detection toner image 100 illustrated in FIGS. 1 and 14 is output.

The transfer-performance-detection toner image 100 output from the image forming apparatus body 1 is read by using the image reading device 4 mounted in the image forming apparatus body 1 or the manual colorimeter 314 connected as an option to the personal computer 300, as illustrated in FIG. 2 or 10. When the transfer-performance-detection toner image 100 is to be read by using the manual colorimeter 314, the manual colorimeter 314 is placed at a read start position illustrated in FIG. 14, and the manual colorimeter 314 is moved, with a "Read" button pressed, in the longitudinal direction along the toner images 101 of process black and the single-color toner images 105 of black (K) on the transfer-performance-detection toner image 100. Therefore, the transfer-performance-detection toner image 100 of the respective colors is read row-by-row.

Figure 15:
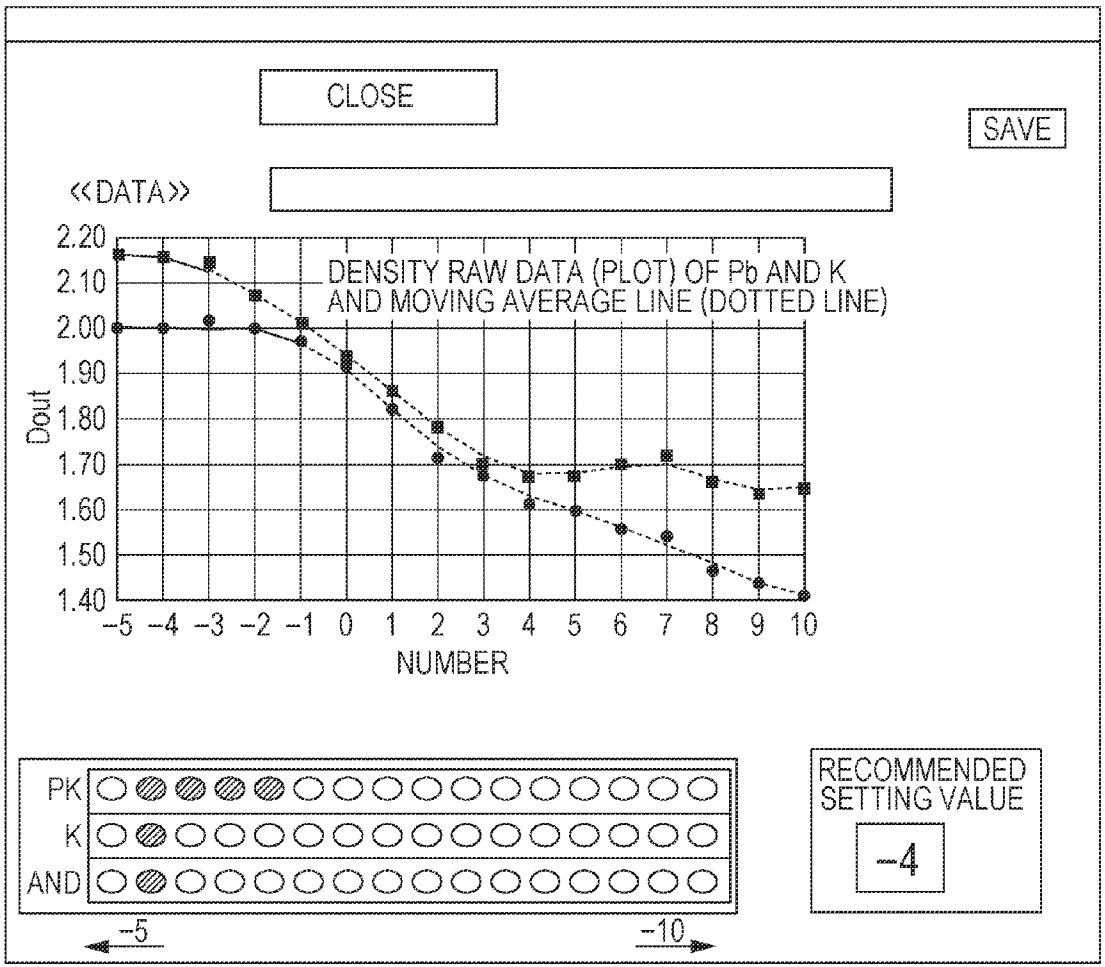
FIG. 15 illustrates a display.

The density data of the transfer-performance-detection toner image 100 read by the manual colorimeter 314 or the image reading device 4 is subjected to arithmetic operation processing by the CPU 301 or the control circuit 2001, and a graph illustrated in FIG. 15 is created.

Figure 16:
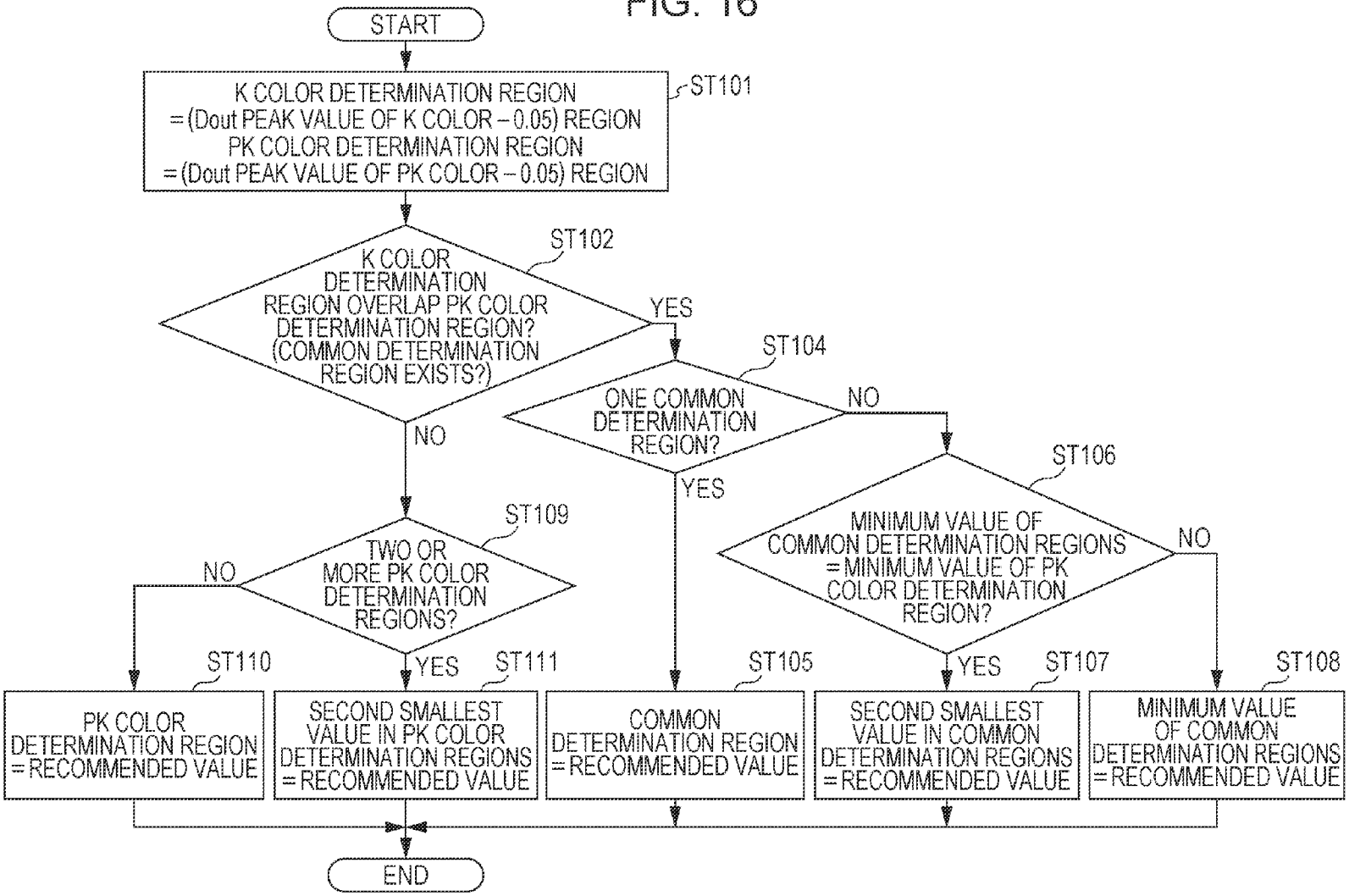
FIG. 16 is a flowchart illustrating the operation of the image forming apparatus according to the first exemplary embodiment of the present invention.

As illustrated in FIG. 16, the CPU 301 or the control circuit 2001 determines the maximum value of the detected densities of single-color toner images of black and a highest-density region of an image having a density lower than the maximum value by a predetermined threshold value, for example, 0.05. The CPU 301 or the control circuit 2001 also determines the maximum value of the detected densities of three-color toner images and a highest-density region of an image having a density lower than the maximum value by a predetermined value, for example, 0.05 (step ST101).

Then, the CPU 301 or the control circuit 2001 determines whether or not there is an overlapping region between the highest-density region of the single-color toners image of black and the highest-density region of the three-color toner images (step ST102). If there is an overlapping region between the highest-density region of the single-color toners image of black and the highest-density region of the three-color toner images, the CPU 301 or the control circuit 2001 determines whether or not there is one overlapping region (step ST104). If there is one overlapping region, the CPU 301 or the control circuit 2001 determines that the value of the one overlapping region is a recommended value of transfer voltage (step ST105), and then the recommended value determination flow ends. If there are plural overlapping regions, it is determined whether or not the set value of the region of process black (K) is the smallest among the overlapping regions (step ST106). If the set value of the region of process black (K) is the smallest among the overlapping regions, the CPU 301 or the control circuit 2001 determines that the second smallest value in the overlapping regions is a recommended value (step ST107), and then the recommended value determination flow ends. If the set value of the region of process black (K) is not the smallest among the overlapping regions, the CPU 301 or the control circuit 2001 determines that the smallest value in the overlapping regions is a recommended value (step ST108), and then the recommended value determination flow ends.

If it is determined that there is no overlapping region between the highest-density region of the single-color toner image of black and the highest-density region of the three-color toner image, the CPU 301 or the control circuit 2001 determines whether or not there are plural regions of process black (K) (step ST109). If there are no plural regions of process black (K), that is, there is one region of process black (K), the CPU 301 or the control circuit 2001 determines that the value of the one region is a recommended value of transfer voltage (step ST110), and then the recommended value determination flow ends. If there are plural regions of process black (K), the CPU 301 or the control circuit 2001 determines that the second smallest value in the plural regions of process black (K) is a recommended value (step ST111), and then the recommended value determination flow ends.

Figure 17:
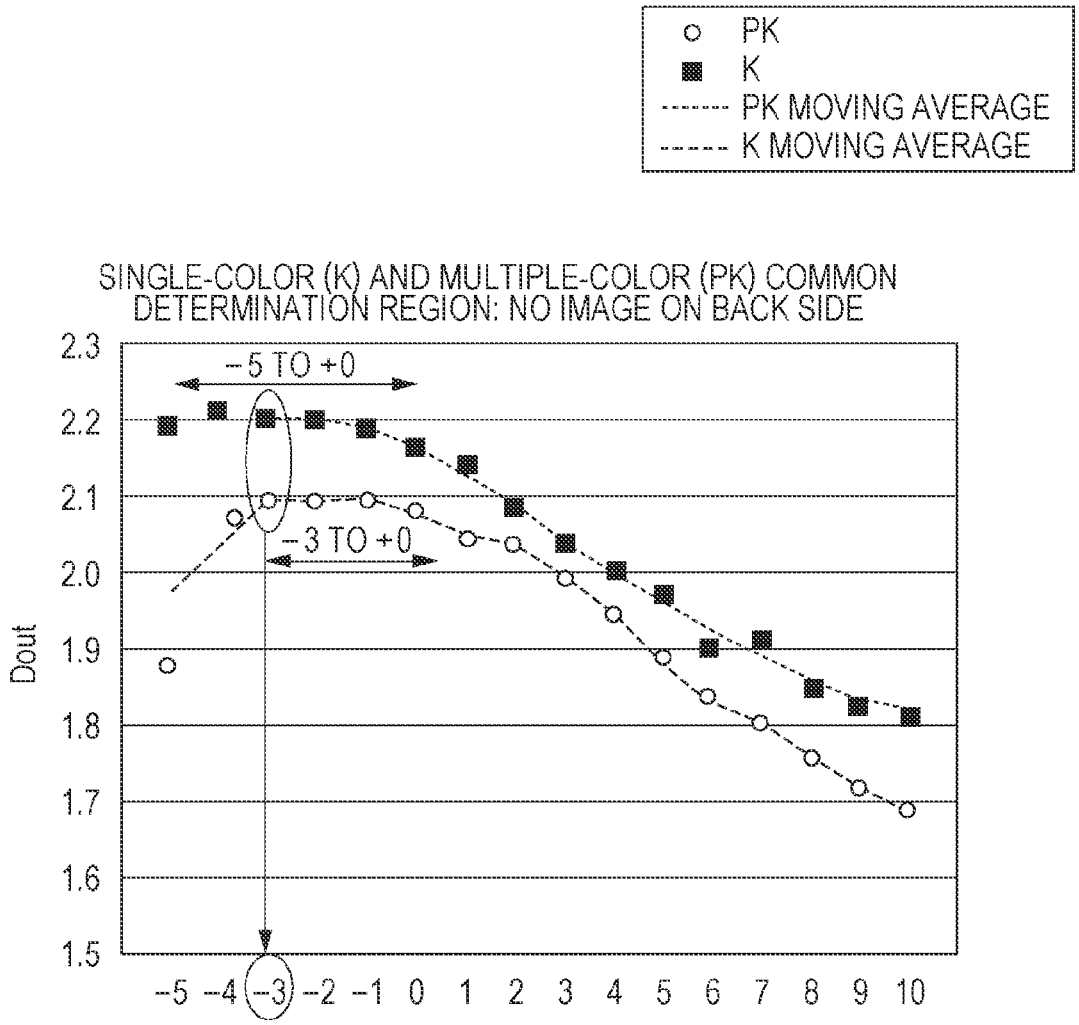
FIG. 17 illustrates a display.
Figure 18:
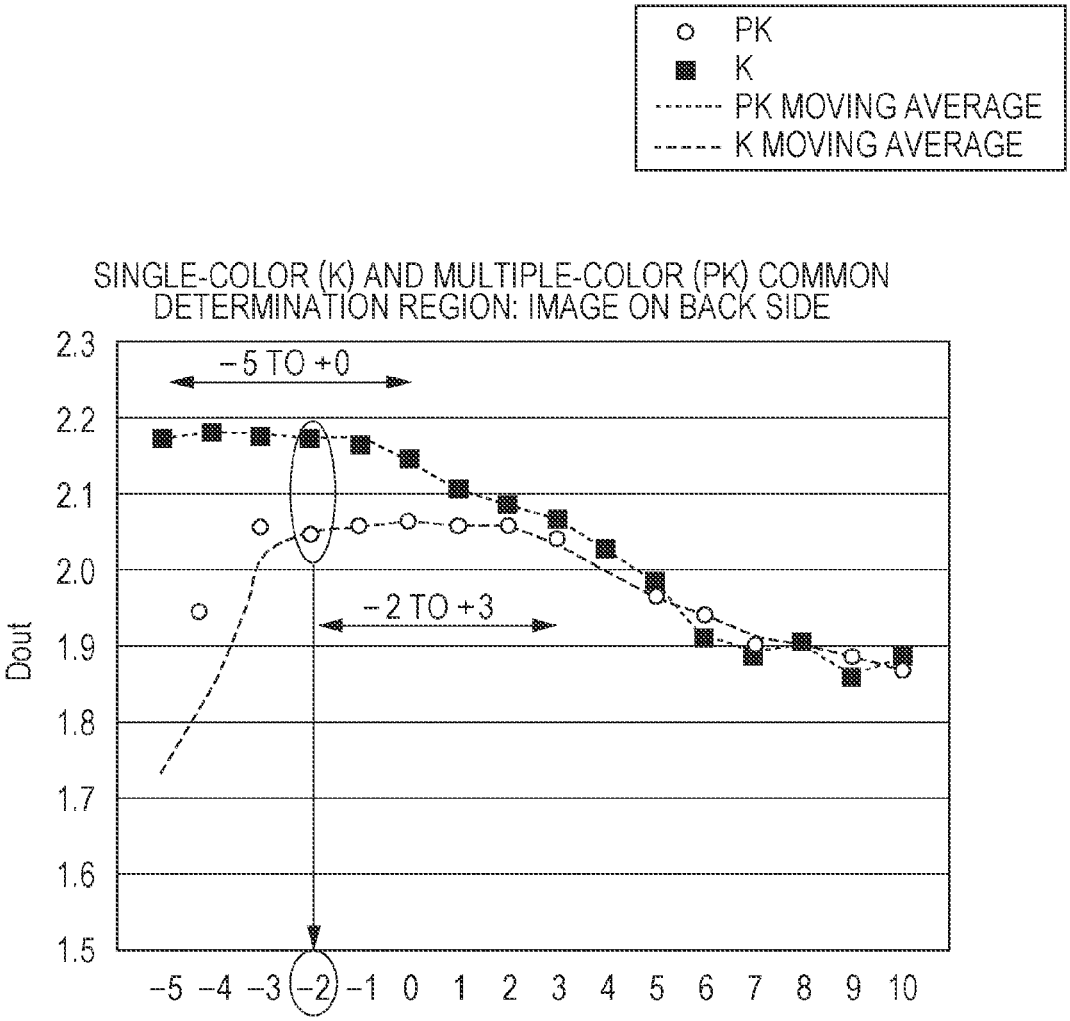
FIG. 18 illustrates a display.

As illustrated in FIGS. 17 and 18, the CPU 301 or the control circuit 2001 executes a similar process on a region where a transfer-performance-detection toner image 100 is formed on the first side of the recording paper 26 with respect to a transfer-performance-detection toner image 100 formed on the second side of the recording paper 26 and on a region where no transfer-performance-detection toner image 100 is formed on the first side of the recording paper 26 with respect to a transfer-performance-detection toner image 100 formed on the second side of the recording paper 26.

Figure 19:
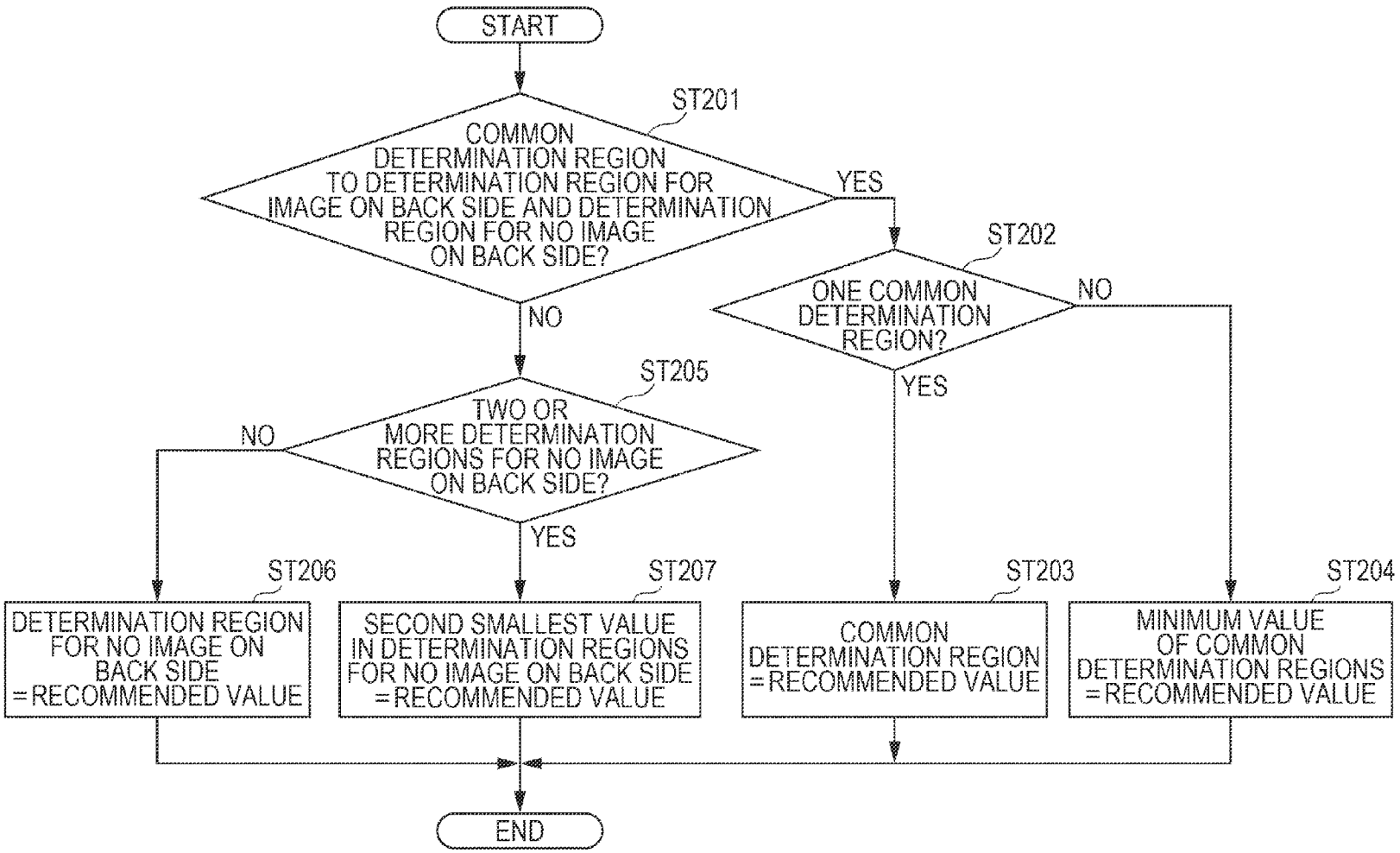
FIG. 19 is a flowchart illustrating the operation of the image forming apparatus according to the first exemplary embodiment of the present invention.

As illustrated in FIG. 19, the CPU 301 or the control circuit 2001 determines whether or not there is an overlapping region as a highest-density region between a region where a transfer-performance-detection toner image 100 is formed on the first side of the recording paper 26 with respect to a transfer-performance-detection toner image 100 formed on the second side of the recording paper 26 and a region where no transfer-performance-detection toner image 100 is formed on the first side of the recording paper 26 with respect to a transfer-performance-detection toner image 100 formed on the second side of the recording paper 26 (step ST201). If there is an overlapping region as a highest-density region, the CPU 301 or the control circuit 2001 determines whether or not there is one overlapping region (step ST202). If there is one overlapping region as a highest-density region, the CPU 301 or the control circuit 2001 determines that the value of the one region, or common region, is a recommended value (step ST203), and then the recommended value determination flow ends. If there are plural overlapping regions as highest-density regions, as illustrated in FIG. 20, the CPU 301 or the control circuit 2001 selects the smallest value in the common regions, and determines the smallest value as a recommended value (step ST204), and then the recommended value determination flow ends.

If it is determined that there is a non-overlapping region as a highest-density region between a region where a transfer-performance-detection toner image 100 is formed on the first side of the recording paper 26 with respect to a transfer-performance-detection toner image 100 formed on the second side of the recording paper 26 and a region where no transfer-performance-detection toner image 100 is formed on the first side of the recording paper 26 with respect to a transfer-performance-detection toner image 100 formed on the second side of the recording paper 26, the CPU 301 or the control circuit 2001 determines that there is two or more non-overlapping regions (step ST205). If there is one non-overlapping region, the CPU 301 or the control circuit 2001 determines that the value of the one non-overlapping region is a recommended value (step ST206). If there are two or more non-overlapping regions, the CPU 301 or the control circuit 2001 determines that the second smallest value among the values of the two or more non-overlapping regions is a recommended value (step ST207). Then, the recommended value determination flow ends.

Second Exemplary Embodiment

Figure 21:
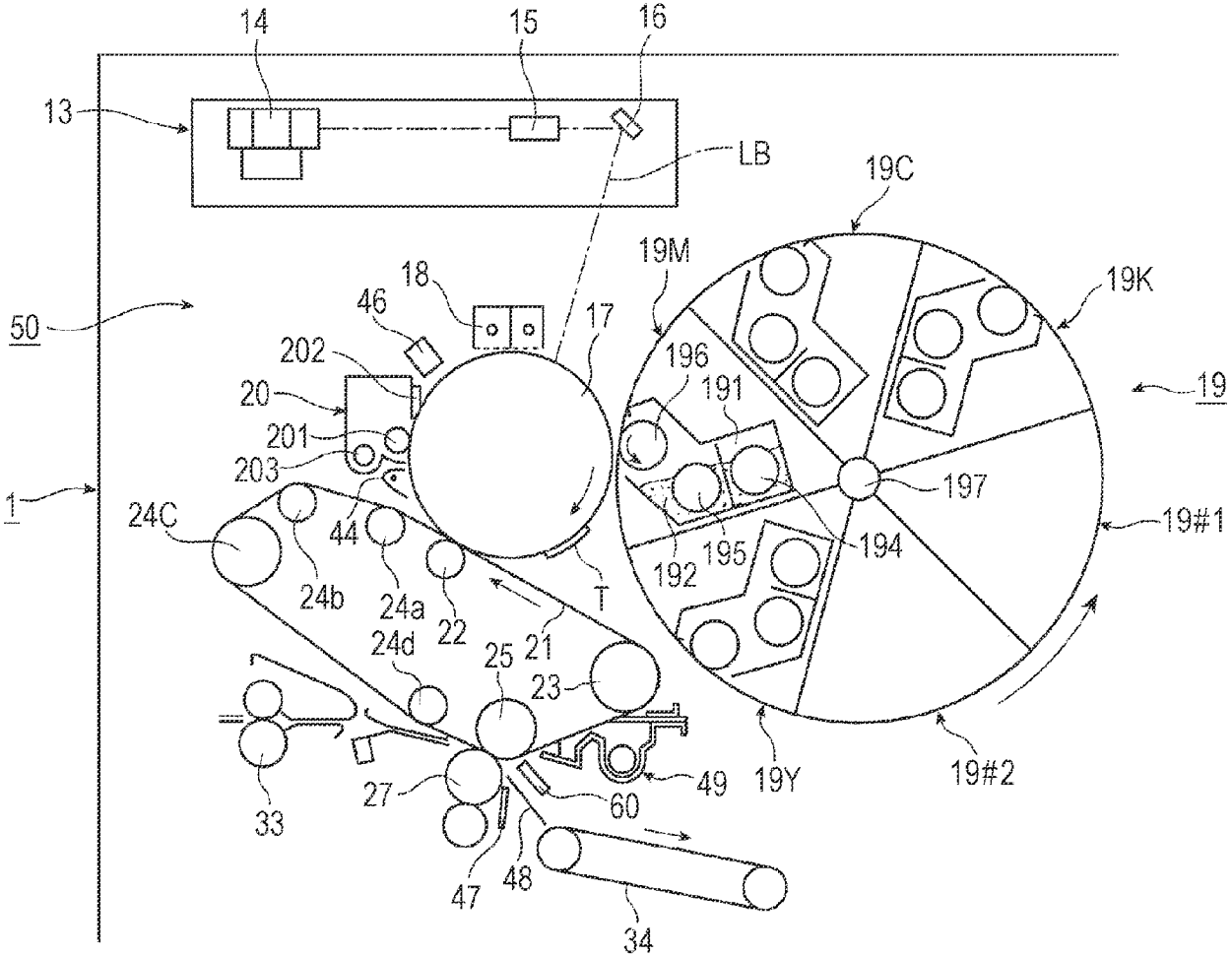
FIG. 21 illustrates an image forming unit of an image forming apparatus according to a second exemplary embodiment of the present invention.

FIG. 21 illustrates a second exemplary embodiment of the present invention. Substantially the same components as those in the first exemplary embodiment are represented by the same numerals. In the second exemplary embodiment, a density detection unit is configured to detect, instead of the densities of plural transfer-performance-detection toner images transferred onto the second side of a recording medium, the densities of plural transfer-performance-detection toner images that remain on an image holding member after plural transfer-performance-detection toner images have been transferred onto the second side of a recording medium.

Specifically, in the second exemplary embodiment, as illustrated in FIG. 21, a density sensor 60 serving as a density detection unit that detects the densities of plural transfer-performance-detection toner images 100 remaining on the intermediate transfer belt 21 after plural transfer-performance-detection toner images 100 have been transferred onto the second side of the recording paper 26 is provided at a position that faces the front side of the intermediate transfer belt 21 and that is downstream of the second transfer unit and upstream of the cleaning device 49 in the movement direction of the intermediate transfer belt 21. The density sensor 60 may be similar to, for example, the image reading element 11 of the image reading device 4, such as a CCD sensor. The density sensor 60 may be any low-cost device configured to detect the densities of transfer-performance-detection toner images 100.

In the second exemplary embodiment, as illustrated in FIG. 21, since a residual toner image on the intermediate transfer belt 21 after plural transfer-performance-detection toner images 100 have been transferred is detected, automatic density detection may be performed. In addition, the density sensor 60 may be more effective especially when plural transfer-performance-detection toner images 100 are likely to remain on the intermediate transfer belt 21.

The other configurations and effects are similar to those of the first exemplary embodiment, and a description thereof is thus omitted.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding member configured to hold a toner image;

a transfer unit configured to transfer the toner image held on the image holding member onto a recording medium having a first side and a second side;

a fixing unit configured to fix the toner image transferred onto the recording medium by the transfer unit;

a transport unit configured to reverse the recording medium having the toner image fixed onto the first side by the fixing unit and configured to transport the reversed recording medium back to the transfer unit;

a transfer-performance-detection toner image forming unit configured to form a plurality of transfer-performance-detection toner images which are arranged in an array and are formed with different transfer settings of the transfer unit so that a transfer-performance-detection toner image to be formed on the first side of the recording medium and a transfer-performance-detection toner image to be formed on the second side of the recording medium at least partly overlap each other;

a density detection unit configured to detect densities of a plurality of transfer-performance-detection toner images transferred onto the second side of the recording medium or densities of a plurality of transfer-performance-detection toner images which remain on the image holding member after a plurality of transfer-performance-detection toner images have been transferred onto the second side of the recording medium; and a selector configured to select a transfer setting of the transfer unit in accordance with a detection result obtained by the density detection unit.

2. The image forming apparatus according to claim 1, wherein the image holding member includes an intermediate transfer body onto which a plurality of toner images sequentially formed on one or a plurality of photoconductor drums are transferred in a superimposed manner, and the transfer-performance-detection toner image forming unit forms a plurality of transfer-performance-detection toner images with different transfer voltages to be applied to the transfer unit.

3. The image forming apparatus according to claim 1, wherein each transfer-performance-detection toner image includes a single toner image, and a superimposed toner image having a plurality of toner images which are superimposed on one another.

4. The image forming apparatus according to claim 3, wherein each transfer-performance-detection toner image includes a toner image formed in such a manner that a single toner image to be formed on the first side of the recording medium overlaps a portion of a single toner image to be formed on the second side of the recording medium and that a superimposed toner image having a plurality of toner images to be formed on the first side of the recording medium which are superimposed on one another overlaps a portion of a superimposed toner image having a plurality of toner images to be formed on the second side of the recording medium which are superimposed on one another.

5. The image forming apparatus according to claim 1, wherein each transfer-performance-detection toner image includes a toner image formed in such a manner that a single toner image to be formed on the first side of the recording medium overlaps a portion of a single toner image to be formed on the second side of the recording medium and that a superimposed toner image having a plurality of toner images to be formed on the first side of the recording medium which are superimposed on one another overlaps a portion of a superimposed toner image having a plurality of toner images to be formed on the second side of the recording medium which are superimposed on one another.

6. The image forming apparatus according to claim 1, wherein the density detection unit is configured to detect a density of a transfer-performance-detection toner image transferred and fixed onto the recording medium.

7. The image forming apparatus according to claim 1, wherein the selector is configured to select a transfer setting for which a transfer-performance-detection toner image having a highest density among the densities detected by the density detection unit is obtained.

8. The image forming apparatus according to claim 7, wherein the density detection unit is configured to detect densities of transfer-performance-detection toner images each including a single toner image and a superimposed toner image having a plurality of toner images which are superimposed on one another, and the selector is configured to automatically or manually select a transfer setting for which a transfer-performance-detection toner image including a single toner image having a highest transfer density and a superimposed toner image having a highest transfer density among the densities detected by the density detection unit is obtained.

9. An image forming system comprising:

an image forming apparatus; and a control device, the image forming apparatus including an image holding member configured to hold a toner image, a transfer unit configured to transfer the toner image held on the image holding member onto a recording medium having a first side and a second side, a fixing unit configured to fix the toner image transferred onto the recording medium by the transfer unit, a transport unit configured to reverse the recording medium having the toner image fixed onto the first side by the fixing unit and that configured to transport the reversed recording medium back to the transfer unit, and a transfer-performance-detection toner image forming unit configured to form a plurality of transfer-performance-detection toner images which are arranged in an array and are formed with different transfer settings of the transfer unit so that a transfer-performance-detection toner image to be formed on the first side of the recording medium and a transfer-performance-detection toner image to be formed on the second side of the recording medium at least partly overlap each other, the control device including a density detection unit configured to detect densities of a plurality of transfer-performance-detection toner images transferred onto the second side of the recording medium or densities of a plurality of transfer-performance-detection toner images which remain on the image holding member after a plurality of transfer-performance-detection toner images have been transferred onto the second side of the recording medium, and a selector configured to select a transfer setting of the transfer unit in accordance with a detection result obtained by the density detection unit.

10. An image forming method comprising:

holding a toner image on an image holding member;

transferring the toner image held on the image holding member onto a recording medium having a first side and a second side;

fixing the toner image transferred onto the recording medium;

reversing the recording medium having the toner image fixed onto the first side and transporting the reversed recording medium back to the transfer unit;

forming a plurality of transfer-performance-detection toner images which are arranged in an array and are formed with different transfer settings for performing a transfer operation so that a transfer-performance-detection toner image to be formed on the first side of the recording medium and a transfer-performance-detection toner image to be formed on the second side of the recording medium at least partly overlap each other;

detecting densities of a plurality of transfer-performance-detection toner images transferred onto the second side of the recording medium or densities of a plurality of transfer-performance-detection toner images which remain on the image holding member after a plurality of transfer-performance-detection toner images have been transferred onto the second side of the recording medium; and selecting a transfer setting for performing a transfer operation in accordance with the detected densities.

11. The image forming apparatus according to claim 1, wherein the plurality of transfer-performance-detection toner images are arranged in a recording medium transfer direction according to a transfer voltage and are arranged in an intersecting direction to the recording medium transfer direction according to color of the transfer-performance-detection toner images.

12. The image forming system according to claim 9, wherein the plurality of transfer-performance-detection toner images are arranged in a recording medium transfer direction according to a transfer voltage and are arranged in an intersecting direction to the recording medium transfer direction according to color of the transfer-performance-detection toner images.

13. The method according to claim 10, wherein the plurality of transfer-performance-detection toner images are arranged in a recording medium transfer direction according to a transfer voltage and are arranged in an intersecting direction to the recording medium transfer direction according to color of the transfer-performance-detection toner images.

* * * * *